US009022616B2

(12) United States Patent
Randolph

(10) Patent No.: US 9,022,616 B2
(45) Date of Patent: May 5, 2015

(54) LENS ASSEMBLY FOR A SOLID-STATE LIGHTING FIXTURE

(71) Applicant: Cree, Inc., Durham, NC (US)

(72) Inventor: David N. Randolph, Rougemont, NC (US)

(73) Assignee: Cree, Inc., Durham, NC (US)

( * ) Notice: Subject to any disclaimer, the term of this patent is extended or adjusted under 35 U.S.C. 154(b) by 106 days.

(21) Appl. No.: 13/836,713

(22) Filed: Mar. 15, 2013

(65) Prior Publication Data

US 2014/0268885 A1 Sep. 18, 2014

(51) Int. Cl.

| | |
|---|---|
| ***F21K 99/00*** | (2010.01) |
| ***F21V 3/04*** | (2006.01) |
| ***F21V 5/00*** | (2006.01) |

(52) U.S. Cl.

CPC . *F21K 9/50* (2013.01); *F21K 9/135* (2013.01); *F21V 3/049* (2013.01); *F21V 5/005* (2013.01)

(58) Field of Classification Search

USPC ..... 362/335, 336, 337, 338, 339, 340, 362/311.02

See application file for complete search history.

(56) References Cited

U.S. PATENT DOCUMENTS

| | | | | |
|---|---|---|---|---|
| 4,142,179 | A * | 2/1979 | Lowndes | 340/321 |
| 7,581,854 | B2 * | 9/2009 | Ford | 362/311.02 |
| 8,434,883 | B2 * | 5/2013 | Doan et al. | 362/84 |
| 8,506,103 | B2 * | 8/2013 | Iimura et al. | 362/84 |
| 8,628,221 | B2 * | 1/2014 | Wang et al. | 362/311.02 |
| 2012/0014116 | A1 * | 1/2012 | Hu | 362/335 |

* cited by examiner

*Primary Examiner* — Laura Tso

(74) *Attorney, Agent, or Firm* — Withrow & Terranova, P.L.L.C.

(57) ABSTRACT

The disclosure relates to a lighting fixture having a base, a solid-state light source, and a lens assembly. The optic has a body with a cavity and a proximal opening. The lens assembly is coupled to the base at the proximal opening. The solid-state light source is mounted to the base and is configured to direct light into the cavity via the proximal opening. At least a portion of an interior surface of the body includes a number of elongated prisms. At least a portion of the exterior surface of the body includes a number of diffusers.

38 Claims, 25 Drawing Sheets

LENS ASSEMBLY FOR A SOLID-STATE LIGHTING FIXTURE

FIELD OF THE DISCLOSURE

Embodiments of the present disclosure relate to lighting fixtures and more particularly to solid-state light fixtures having light emittance characteristics that mimic light emittance characteristics of non-solid-state lighting fixtures.

BACKGROUND

In recent years, a movement has gained traction to replace incandescent and fluorescent light bulbs with solid-state lighting devices that employ more efficient lighting technologies. One such technology that shows tremendous promise employs LEDs. Compared with incandescent light bulbs, LED-based light devices are more efficient and longer lasting. Compared to fluorescent bulbs, LED-based light devices are longer lasting. As a result of these advantages over incandescent and fluorescent lighting fixtures lighting fixtures that employ LED technologies are expected to replace incandescent and fluorescent bulbs in residential, commercial, and industrial applications.

SUMMARY

The disclosure relates to a lighting fixture having a base, a solid-state light source, and a lens assembly. The optic has a body with a cavity and a proximal opening. The lens assembly is coupled to the base at the proximal opening. The solid-state light source is mounted to the base and is configured to direct light into the cavity via the proximal opening. At least a portion of an interior surface of the body includes a number of elongated prisms. At least a portion of the exterior surface of the body includes a number of diffusers.

The light directed into the cavity by the solid-state light source is significantly refracted and reflected by the prisms. Light passing through the prisms or other part of the body may be diffused by the diffusers as it departs the lens assembly. From a viewing perspective, the resultant light that departs the lens assembly appears to have originated from an interior portion of the cavity in the lens assembly, as opposed to emanating from the solid-state light source.

By causing the light to appear to originate from the interior portion of the cavity, the lens assembly allows the lighting fixture to emulate a traditional light source, such as a traditional incandescent bulb with an Edison-type screw-in base, a compact fluorescent lamp (CFL), and the like. The light generated in these traditional bulbs actually originates from an interior portion of the bulb's lens assembly, as opposed to originating from a base on which the lens assembly is mounted. As such, light emanating from the lens assembly of the present disclosure appears as light from a traditional light source, and as such, the radiant flux distribution of the lighting fixture mimics the radiant flux distribution of a traditional light source.

The lens assembly and base may take on virtually any shape to form a new lighting fixture design or may emulate a traditional light bulb or lighting fixture. The prisms and the diffusers may be elongated structures that are substantially parallel with one another and either continuous, substantially continuous, or discontinuous over the respective interior and exterior portions of the body. The prisms may have triangular or other cross-sectional profiles, while the diffusers may have semi-hemispherical or other cross-sectional profiles. The prisms and diffusers may be substantially uniform in width or may be tapered to varying degrees. The prisms and diffusers may also be immediately adjacent or spaced apart from one another.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 2:
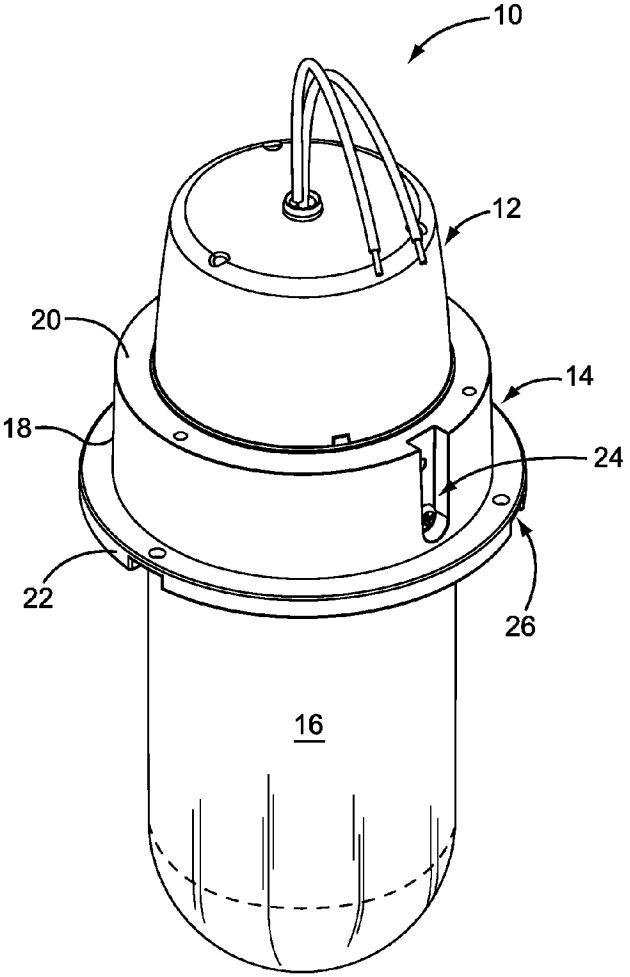
FIG. 2 is an isometric view of the back of the lighting fixture of FIG. 1.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The disclosure relates to a lighting fixture having a base, a solid-state light source, and a lens assembly. In general, the optic has a body with a cavity and a proximal opening. The lens assembly is coupled to the base at the proximal opening. The solid-state light source is mounted to the base and is configured to direct light into the cavity via the proximal opening. At least a portion of an interior surface of the body includes a number of elongated prisms. At least a portion of the exterior surface of the body includes a number of diffusers.

The light directed into the cavity by the solid-state light source is significantly refracted and reflected by the prisms. Light passing through the prisms or other part of the body may be diffused by the diffusers as it departs the lens assembly. From a viewing perspective, the resultant light that departs the lens assembly appears to have originated from an interior portion of the cavity in the lens assembly, as opposed to emanating from the solid-state light source.

By causing the light to appear to originate from the interior portion of the cavity, the lens assembly allows the lighting fixture to emulate a traditional light source, such as a traditional incandescent bulb with an Edison-type screw-in base, a compact fluorescent lamp (CFL), and the like. The light generated in these traditional bulbs actually originates from an interior portion of the bulb's lens assembly, as opposed to originating from a base on which the lens assembly is mounted. As such, light emanating from the lens assembly of the present disclosure appears as light from a traditional light source, and as such, the radiant flux distribution of the lighting fixture mimics the radiant flux distribution of a traditional light source. Details are provided below.

Figure 1:
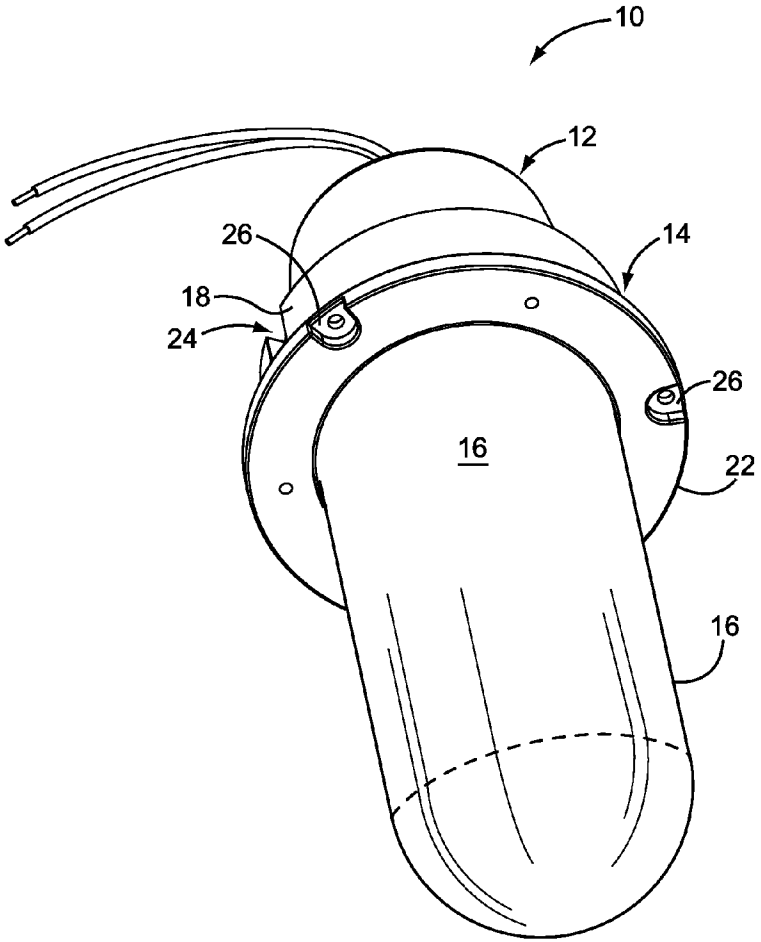
FIG. 1 is an isometric view of the front of a lighting fixture according to one embodiment of the disclosure.
Figure 3:
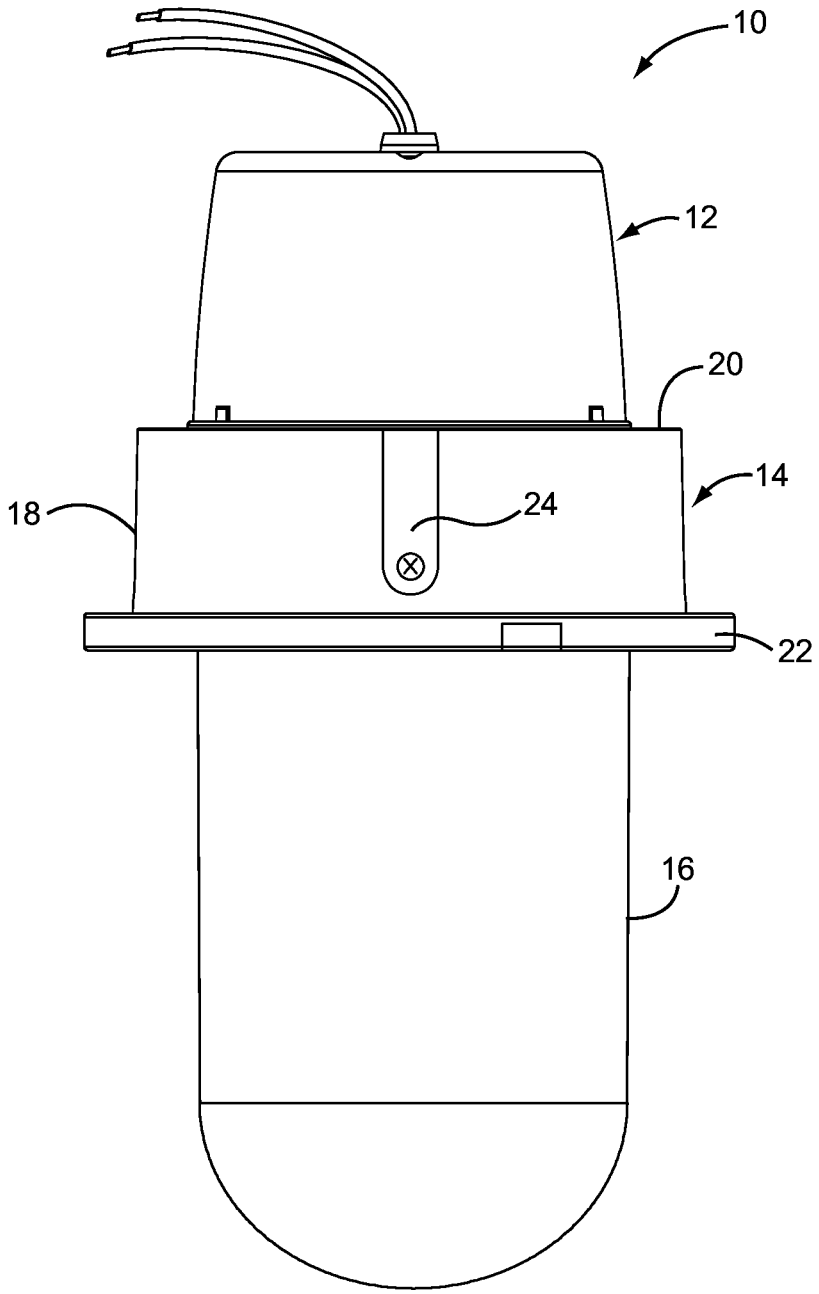
FIG. 3 is a side plan view of the lighting fixture of FIG. 1.

With reference to FIGS. 1-3, a lighting fixture 10 is illustrated according to one embodiment of the present disclosure. As shown, the lighting fixture 10 includes a control module 12, a base 14 that is shaped like a cup and acts as a heat spreading structure, and a lens assembly 16. A light source (not shown), which will be described in detail further below, is mounted inside the base 14 and oriented such that light is emitted from the base through the lens assembly 16. The electronics (not shown) that are required to power and drive the light source are provided, at least in part, by the control module 12. The lighting fixture 10 for this particular embodiment can be used in 4, 5, and 6 inch recessed lighting applications for industrial, commercial, and residential applications. In addition, those skilled in the art will recognize that the concepts disclosed herein are applicable to virtually any size and application, e.g., CFL replacements, incandescent replacements.

The lens assembly 16 may be formed from various materials, such as polycarbonate or acrylic. As will be detailed further below, the lens assembly 16 has a body that will include elongated prisms on an at least a portion of the interior surface and elongated diffusers on at least a portion of the exterior surface. The prisms will act to reflect/refract and the diffusers will act to diffuse the light that emanates from the light source and ultimately exits via the lens assembly 16. Further, the lens assembly 16 may also be configured to shape or direct the exiting light in any desired manner.

The control module 12 and the base 14 may be integrated and provided by a single structure. Alternatively, the control module 12 and the base 14 may be modular, wherein different sizes, shapes, and types of control modules 12 may be attached or otherwise connected to the base 14 and used to drive the light source provided therein.

Further, the lighting fixture 10 may be designed to work with different types of control modules 12 wherein different control modules 12 may interchangeably attach to the base 14, and can be used to drive the light source 34 provided in the base 14. For example, the control module 12 may be readily attached to and detached from the base 14 wherein plugs or apertures are provided in each device to facilitate the necessary electrical connection between the two devices. As such, different manufactures are empowered to design and manufacture control modules 12 for another manufacture's base 14 and light source 34 assembly, and vice versa. Further, different sizes, shapes, and sizes of control modules 12 may be manufactured for a given base 14 and light source 34 assembly, and vice versa.

In this embodiment, the base 14 is made of a material that provides good thermal conductivity, such as metal, ceramic, or the like. In the disclosed embodiment the base 14 is formed from aluminum, but other metals, or thermally conductive materials, are applicable. The illustrated lighting fixture 10 is particularly beneficial for recessed lighting applications wherein most if not all of the lighting fixture 10 is recessed into a cavity within a wall, ceiling, cabinet, or like structure. Heat generated by the light source or electronics of the control module 12 is often trapped within the cavity. After prolonged operation, even an efficient lighting fixture 10 can cause sufficient heat to be trapped in the cavity, which may cause damage to the lighting fixture 10 itself or to its surroundings.

Instead of directing heat transfer toward the rear of the lighting fixture 10 and into the cavity in which the lighting fixture 10 is mounted, the lighting fixture 10 of this embodiment employs the base 14 to direct heat transfer toward the front of the lighting fixture 10. Even when mounted into a cavity, the front of the lighting fixture 10 is either exposed to ambient, or in select embodiments, coupled to a mounting can that is also exposed to ambient. By directing heat transfer toward the front of the lighting fixture 10, the amount of heat that would otherwise be directed into the cavity in which the lighting fixture 10 is mounted is significantly reduced. By reducing the amount of heat directed toward the rear of the lighting fixture 10, the performance and longevity of the lighting fixture 10 may be enhanced, the number of acceptable mounting conditions and applications may be increased, the cost of the lighting fixture 10 may be reduced by being able to use less expensive components, or any combination thereof.

In the illustrated embodiment, the base 14 is cup-shaped and includes a sidewall 18 that extends between a bottom panel 20 at the rear of the base 14, and a rim, which may be provided by an annular flange 22 at the front of the base 14. One or more elongated slots 24 may be formed in the outside surface of the sidewall 18. As illustrated, there are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the base 14 inside the elongated slot 24, connecting additional elements to the lighting fixture 10, or as described further below, securely attaching the lens assembly 16 to the base 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 4:
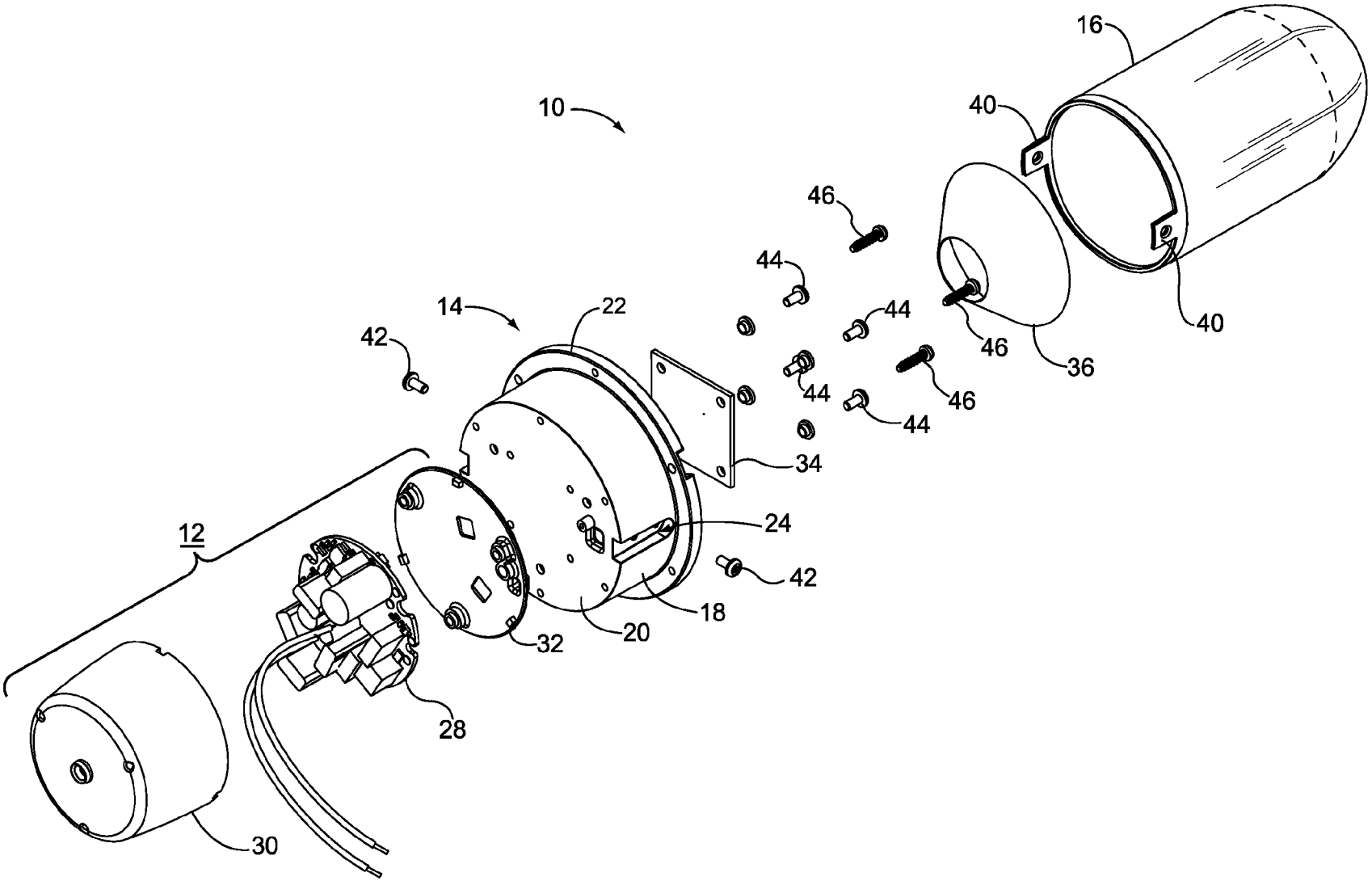
FIG. 4 is an exploded isometric view of the lighting fixture of FIG. 1.

With reference to FIG. 4, an exploded view of the lighting fixture 10 of FIGS. 1-3 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the base 14.

The control module electronics 28 may be used to provide all or a portion of power and control signals necessary to power and control a light source 34, which may be mounted on the front surface of the bottom panel 20 of the base 14. Aligned holes or openings in the bottom panel 20 of the base 14 and the control module cover 32 are provided to facilitate an electrical connection between the control module electronics 28 and the light source 34. In the illustrated embodiment, the light source 34 is a solid-state light source, and in particular, employs one or more light emitting diodes (LEDs) and associated electronics, which are mounted to a printed circuit board (PCB) to generate light at a desired magnitude and color temperature. The LEDs are mounted on the front side of the PCB, while the rear side of the PCB is mounted to the front surface of the bottom panel 20 of the base 14 directly or via a thermally conductive pad (not shown). The thermally conductive pad has a low thermal resistivity, and therefore, efficiently transfers heat that is generated by the light source 34 to the bottom panel 20 of the base 14.

While various mounting mechanisms are available, the illustrated embodiment employs four bolts 44 to attach the PCB of the light source 34 to the front surface of the bottom panel 20 of the base 14. The bolts 44 screw into threaded holes provided in the front surface of the bottom panel 20 of the base 14. Three bolts 46 are used to attach the base 14 to the control module 12. In this particular configuration, the bolts 46 extend through corresponding holes provided in the base 14 and the control module cover 32 and screw into threaded apertures (not shown) provided just inside the rim of the control module housing 30. As such, the bolts 46 effectively sandwich the control module cover 32 between the base 14 and the control module housing 30.

A reflector cone 36 resides within the interior chamber provided by the base 14. In the illustrated embodiment, the reflector cone 36 has a conical wall that extends between a larger front opening and a smaller rear opening. The larger front opening resides at and substantially corresponds to the dimensions of front opening in the base 14 that corresponds to the front of the interior chamber provided by the base 14. The smaller rear opening of the reflector cone 36 resides about and substantially corresponds to the size of the LED or array of LEDs provided by the light source 34. The front surface of the reflector cone 36 is generally, but not necessarily, highly reflective in an effort to increase the overall efficiency of the lighting fixture 10. In one embodiment, the reflector cone 36 is formed from metal, paper, a polymer, or a combination thereof. In essence, the reflector cone 36 provides a mixing chamber for light emitted from the light source 34, and as described further below, may be used to help direct or control how the light exits the mixing chamber through the lens assembly 16.

Figure 5:
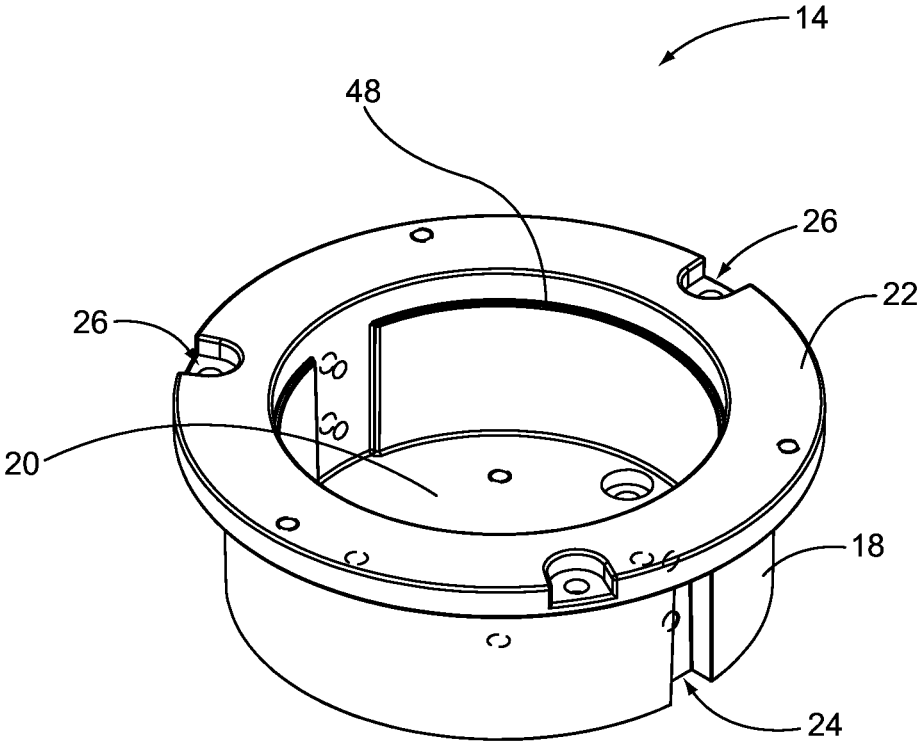
FIG. 5 is an isometric view of the front of the base of the lighting fixture of FIG. 1.
Figure 6:
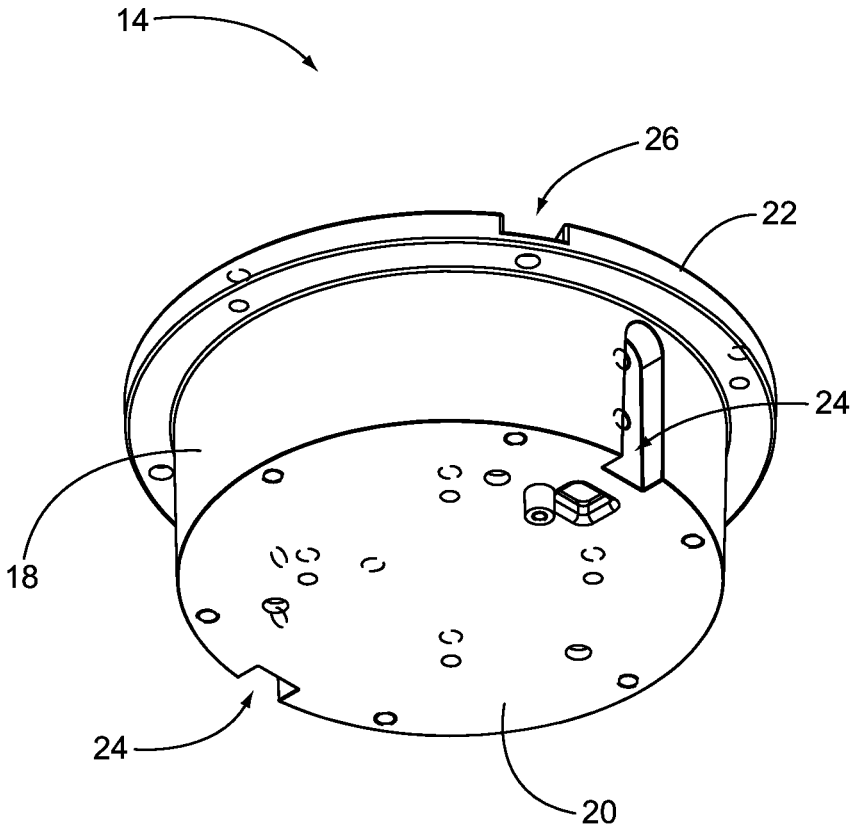
FIG. 6 is an isometric view of the rear of the base of the lighting fixture of FIG. 1.

When assembled, the lens assembly 16 is mounted on or to the annular flange 22 and may be used to hold the reflector cone 36 in place within the interior chamber of the base 14. In the illustrated embodiment, the opening for the lens assembly 16 generally corresponds in shape and size to the front opening of the base 14 and is mounted such that the front surface of the lens is substantially flush with the front surface of the annular flange 22. As shown in FIG. 5, a recess 48 is provided on the interior surface of the sidewall 18 and substantially around the opening of the base 14. The recess 48 provides a ledge on which the lens assembly 16 rests inside the base 14. The recess 48 may be sufficiently deep such that the front surface of the lens assembly 16 is flush with the front surface of the annular flange 22. FIG. 6 provides a rear perspective of the base 14 without the control module 12.

Returning to FIG. 4, the lens assembly 16 may include tabs 40, which extend rearward from the outer periphery of the lens assembly 16. The tabs 40 may slide into corresponding channels on the interior surface of the sidewall 18 (see FIGS. 5 and 7). The channels are aligned with corresponding elongated slots 24 on the exterior of the sidewall 18. The tabs 40 have threaded holes that align with holes provided in the grooves and elongated slots 24. When the lens assembly 16 resides in the recess 48 at the front opening of the base 14, the holes in the tabs 40 will align with the holes in the elongated slots 24. Bolts 42 may be inserted through the holes in the elongated slots and screwed into the holes provided in the tabs 40 to affix the lens assembly 16 to the base 14. When the lens assembly 16 is secured, the reflector cone 36 is contained between the lens assembly 16 and PCB of the light source 34.

Figure 7:
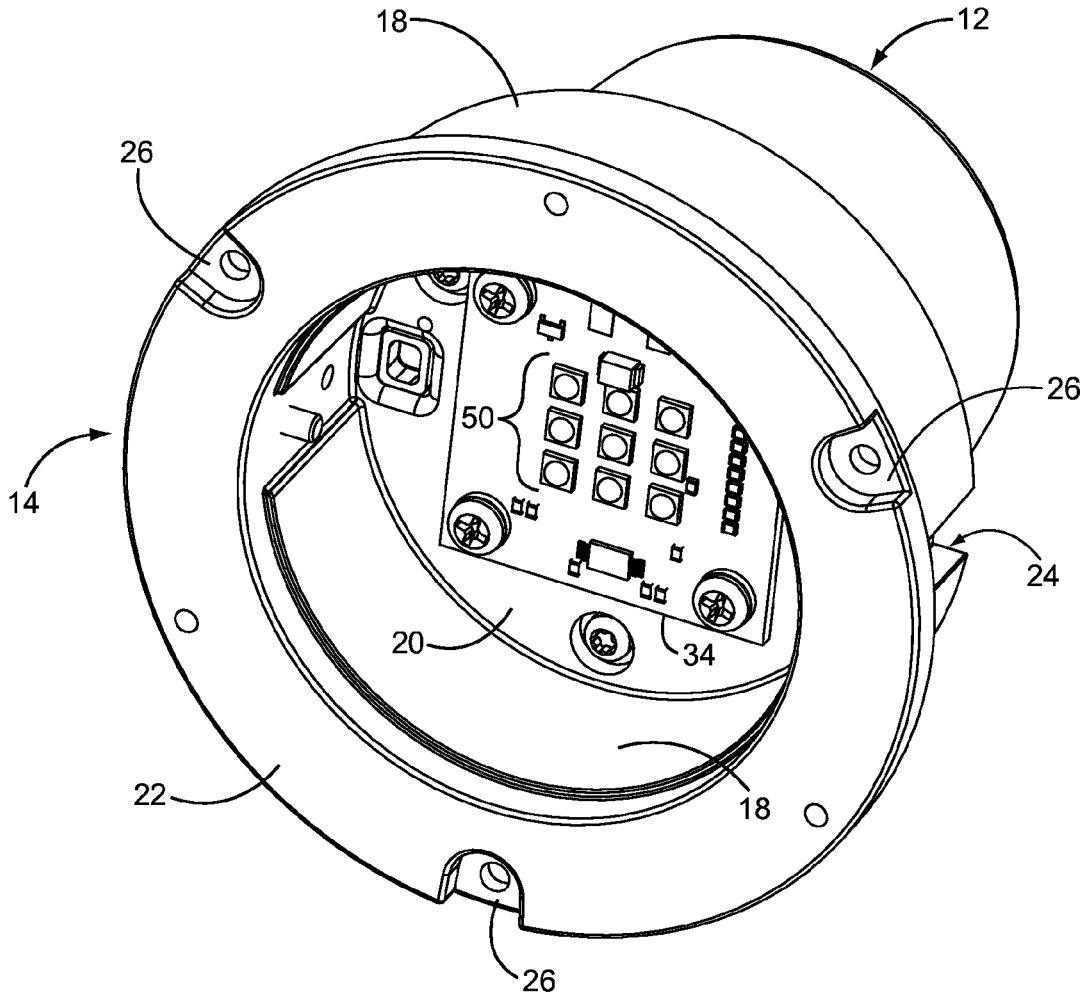
FIG. 7 is an isometric view of the front of the base of the lighting fixture of FIG. 1 without the lens assembly and reflector.

For LED-based applications, the light source 34 provides an array of LEDs 50, as illustrated in FIG. 7. FIG. 7 illustrates a front isometric view of the lighting fixture 10, with the lens assembly 16, diffuser 38, and reflector cone 36 removed. Light emitted from the array of LEDs 50 is mixed inside the mixing chamber formed by the reflector cone 36 (not shown) and directed out through the lens assembly 16 in a forward direction to form a light beam. The array of LEDs 50 of the light source 34 may include LEDs that emit the same or different colors of light. For example, the array of LEDs 50 may be configured such that each LED emits white light. Alternatively, the array of LEDs 50 may include both red LEDs that emit red light and blue-shifted yellow (or green) LEDs that emit bluish-yellow light, wherein the red and bluish-yellow light is mixed to form "white" light at a desired color temperature. For a uniformly colored light beam, relatively thorough mixing of the light emitted from the array of LEDs 50 is desired.

Figure 8:
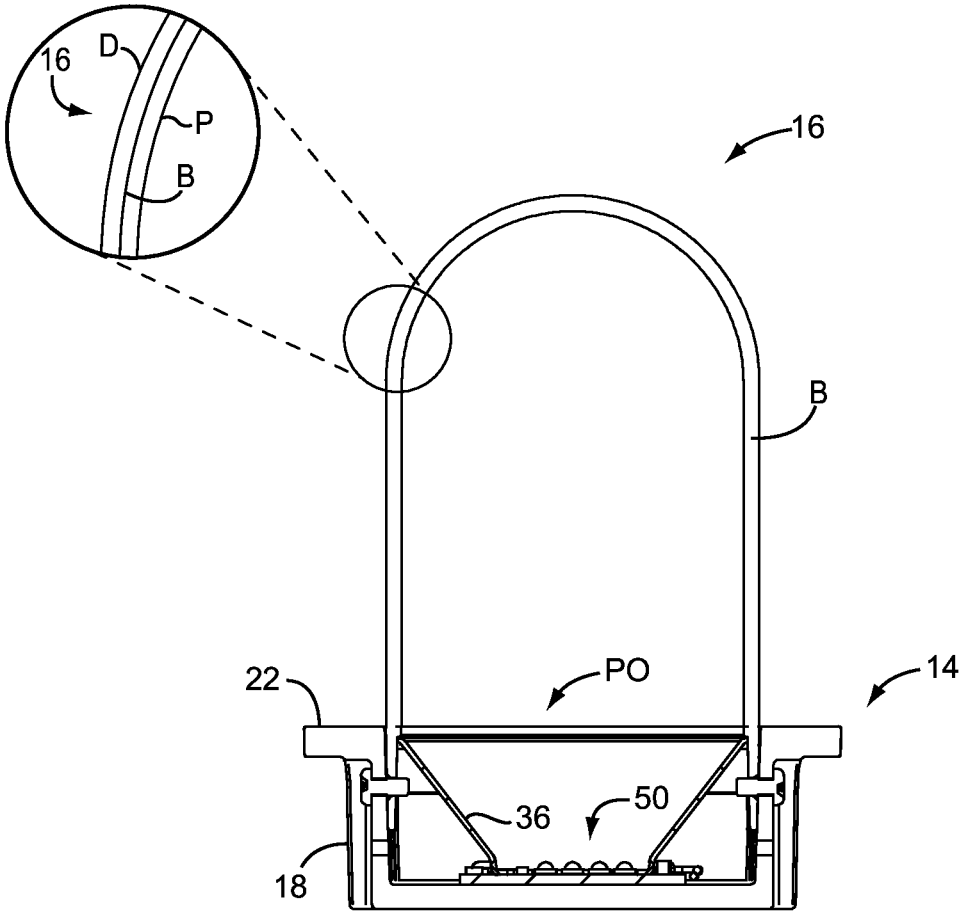
FIG. 8 is a cross-sectional view of the lighting fixture of FIG. 1.

The configuration of the lens assembly 16, along with the reflector 36, if provided, aids in thoroughly mixing the light. In particular, the light that ultimately exits the lens assembly 16 is mixed such that it appears to have originated from within a cavity provided by the lens assembly 16, instead of from the array of LEDs 50, which is located in the base 14. This phenomenon is facilitated by unique application of a number of diffusers D and prisms P on the lens assembly 16, as illustrated in FIG. 8.

As illustrated, lens assembly 16 has a body B with an interior cavity and a proximal opening PO, through which light emanating from the array of LEDs 50 is injected into the cavity. The body B naturally has an interior surface and an exterior surface. At least a portion of an interior surface of the body B includes a number of prisms P. At least a portion of the exterior surface of the body B includes a number of diffusers D. The light injected into in the cavity of the body B by the array of LEDs 50 is significantly refracted and reflected by the prisms P. Light passing through the prisms P is then significantly diffused by the diffusers D as it departs the lens assembly 16. From a viewing perspective, the resultant light that departs the lens assembly 16 appears to have originated from an interior portion of the cavity in the lens assembly 16, as opposed to emanating from the array of LEDs 50. By causing the light to appear to originate from the interior portion of the cavity, the lens assembly 16 allows the lighting fixture to emulate a traditional light source, such as a traditional incandescent bulb with an Edison-type screw-in base, a compact fluorescent lamp (CFL), metal halide fixture, and the like, wherein the generated light actually originates from an interior portion of the lens assembly, as opposed to originating from a base on which the lens assembly is mounted. As such, light emanating from the lighting fixture 10 appears as light from a traditional light source and the radiant flux distribution of the lighting fixture mimics the radiant flux distribution of a traditional light source. As described further below, the base 14 and lens assembly 16 may take on widely varying shapes and configurations. In these configurations, the lighting fixtures 10 may emulate traditional bulbs and be configured as replacements for such bulbs. Examples are provided in the latter section of this disclosure.

Figure 9:
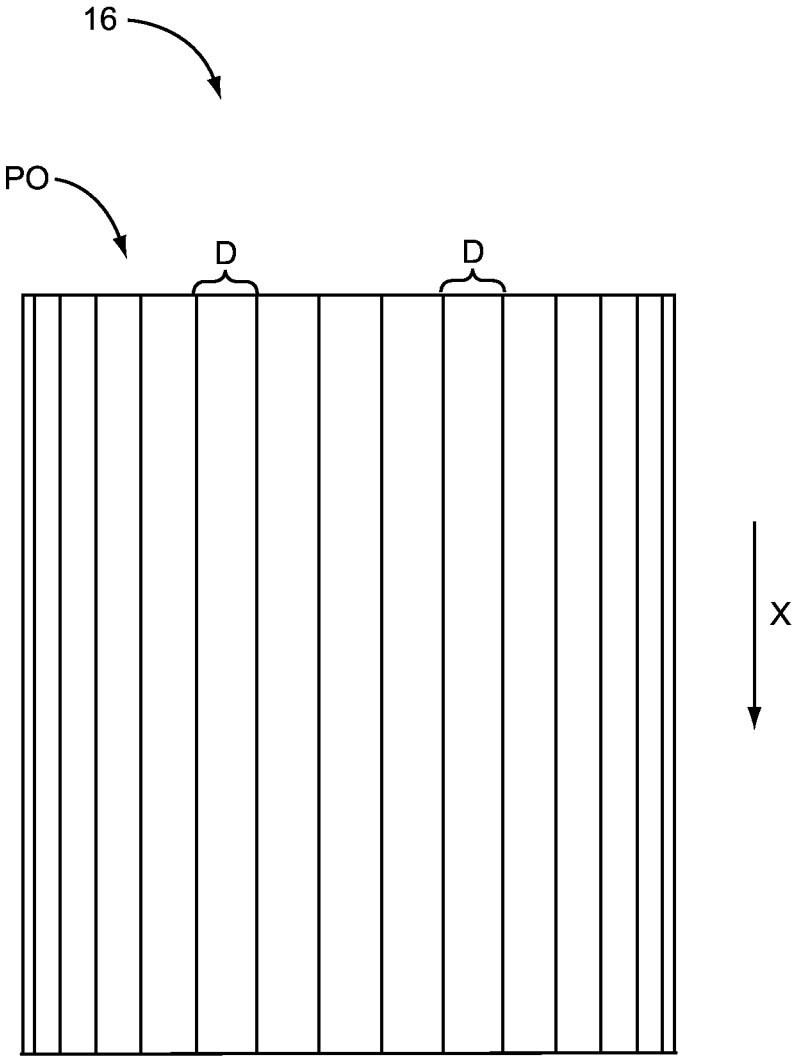
FIG. 9 is an exterior view of a portion of the lens assembly of FIG. 1.

FIG. 9 is a side view of the exterior cylindrical portion of the lens assembly 16 of FIG. 1. As illustrated, the diffusers D may be elongated, and run substantially parallel to one another along all or a significant portion of the exterior surface of the body B. Only the cylindrical portion of the lens assembly 16 is illustrated for clarity (the end cap is not shown in this figure). The diffusers D may or may not continue past the cylindrical portion and cover all or a portion of the end portion. As illustrated, the diffusers D are immediately adjacent one another, but may be spaced apart from one another wherein the exterior surface of the body B is exposed between adjacent diffusers D. Light enters the proximal opening PO in the X direction.

Figure 10:
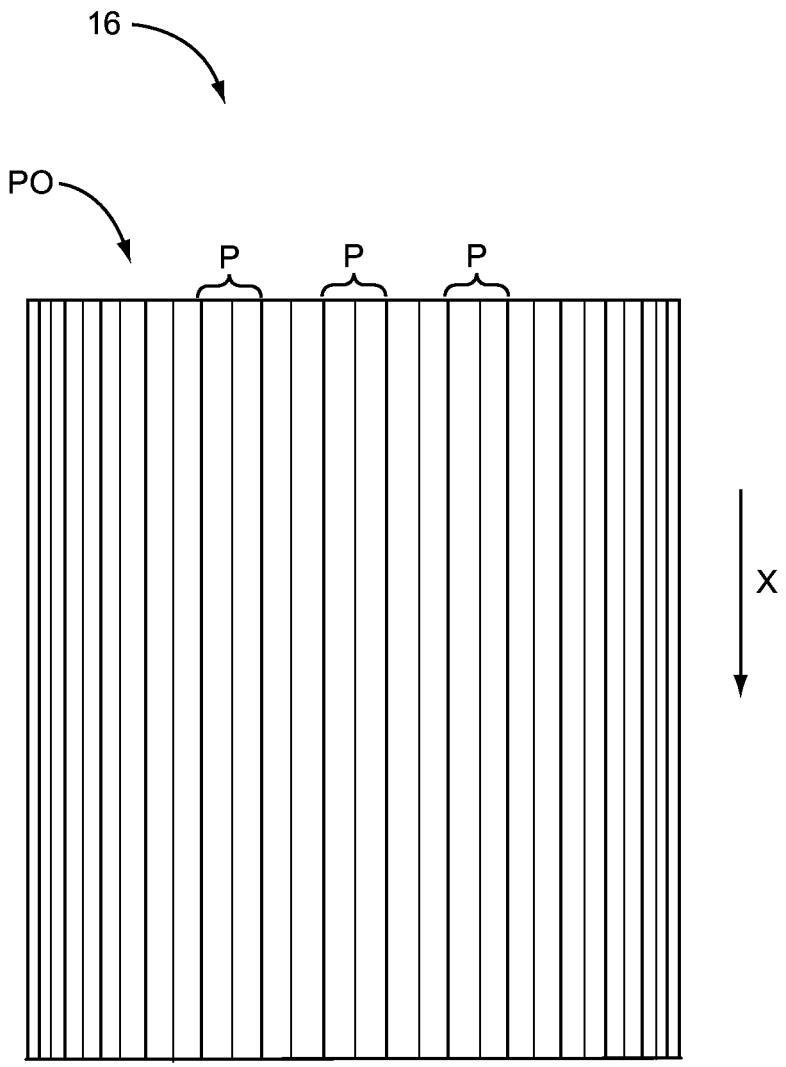
FIG. 10 is an interior view of a portion of the lens assembly of FIG. 1.

FIG. 10 is a "vertical" cross-sectional view of the interior cylindrical portion of the lens assembly 16 of FIG. 1. In an analogous fashion to the diffusers D of FIG. 9, the prisms P may be elongated, and run substantially parallel to one another along all or a significant portion of the interior surface of the body B. Again, only the cylindrical portion of the lens assembly 16 is illustrated for clarity (the end cap is not shown in this figure). The prisms P may or may not continue past the cylindrical portion and cover all or a portion of the end portion. As illustrated, the prisms P are immediately adjacent one another, but may be spaced apart from one another wherein the interior surface of the body B is exposed between adjacent prisms P. Light enters the proximal opening PO in the X direction.

Figure 11:
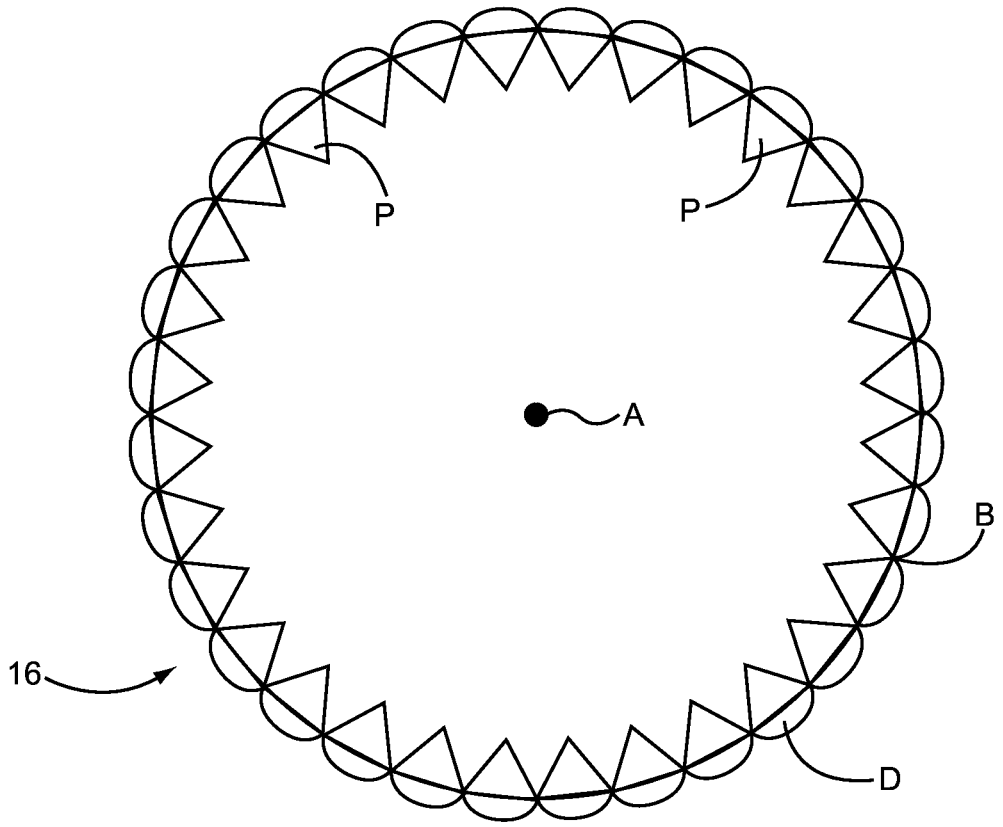
FIG. 11 is a horizontal cross-sectional view of the lens assembly of FIG. 1 and other subsequent embodiments.

FIG. 11 is a "horizontal" cross-sectional view of the cylindrical portion of the lens assembly 16 of FIG. 1. In this view, exemplary cross-sectional shapes of the prisms P and the diffusers D are illustrated. Also depicted is a central axis A, which runs along the geometric center of the lens assembly 16. While central axis A is linear in the embodiment due to the cylindrical nature of the lens assembly 16 of FIG. 1, the central axis A may be non-linear for those embodiments where body is curvilinear. Examples of such are provided later in the disclosure.

As illustrated, the cross-sectional shape of each of the prisms P is substantially triangular, and the cross-sectional shape of each of the diffusers D is substantially semi-hemispherical, which is defined to include precisely hemispherical as well as elliptical and similar dome shapes. Other cross-sectional shapes for the prisms P and diffusers D are applicable, assuming they are configured to aid in mixing and diffusion, respectively, to accomplish the above-stated objectives.

FIGS. 12-16 illustrate alternative layouts for the prisms P. The diffusers D may have analogous layouts to the prism layouts of FIGS. 12-16. Notably, the prisms P and the diffusers D may, but need not, have corresponding layouts as provided in FIGS. 9-11.

Figure 12:
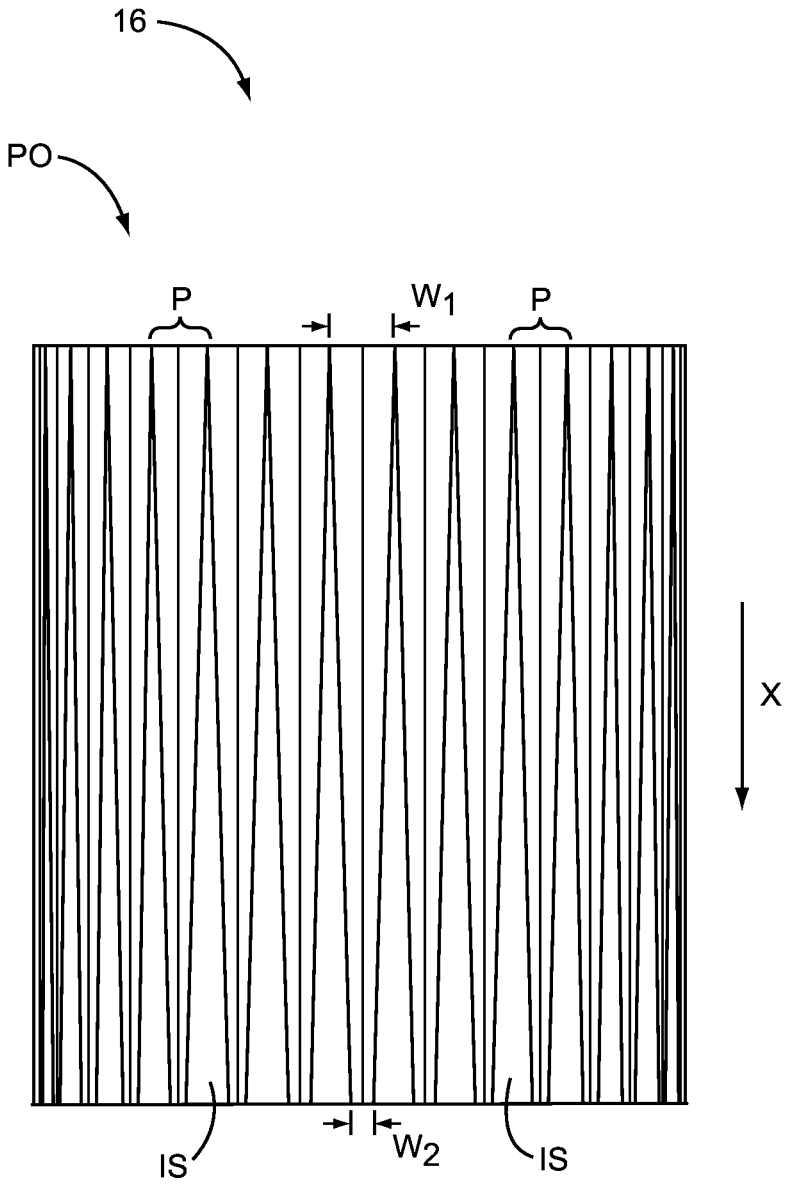
FIG. 12 is an interior view of a portion of the lens assembly according to a second embodiment of the disclosure.

FIG. 12 is a "vertical" cross-sectional view of the interior cylindrical portion of the lens assembly 16. In this example, the prisms P are again elongated, and run substantially parallel to one another along all or a significant portion of the interior surface of the body B. However, each prism P continuously tapers from a wider width $W_1$ at the proximal opening PO to a narrower width $W_2$ along the X direction. Again, only the cylindrical portion of the lens assembly 16 is illustrated for clarity (the end cap is not shown in this figure). The prisms P may or may not continue past the cylindrical portion and cover all or a portion of the end portion. As illustrated, the prisms P are immediately adjacent one another near the proximal opening, but become more spaced apart as they become more narrow along the X direction. As such, the interior surface IS of the body B is exposed between adjacent prisms P when the prisms P are not immediately adjacent one another. Alternatively, each prism P may continuously taper from a narrower width $W_1$ at the proximal opening PO to a wider width $W_2$ along the X direction. The diffusers D may be similarly configured. As such, each diffuser D may continuously taper from a wider width $W_1$ at the proximal opening PO to a narrower width $W_2$ along the X direction, and vice versa.

Figure 13:
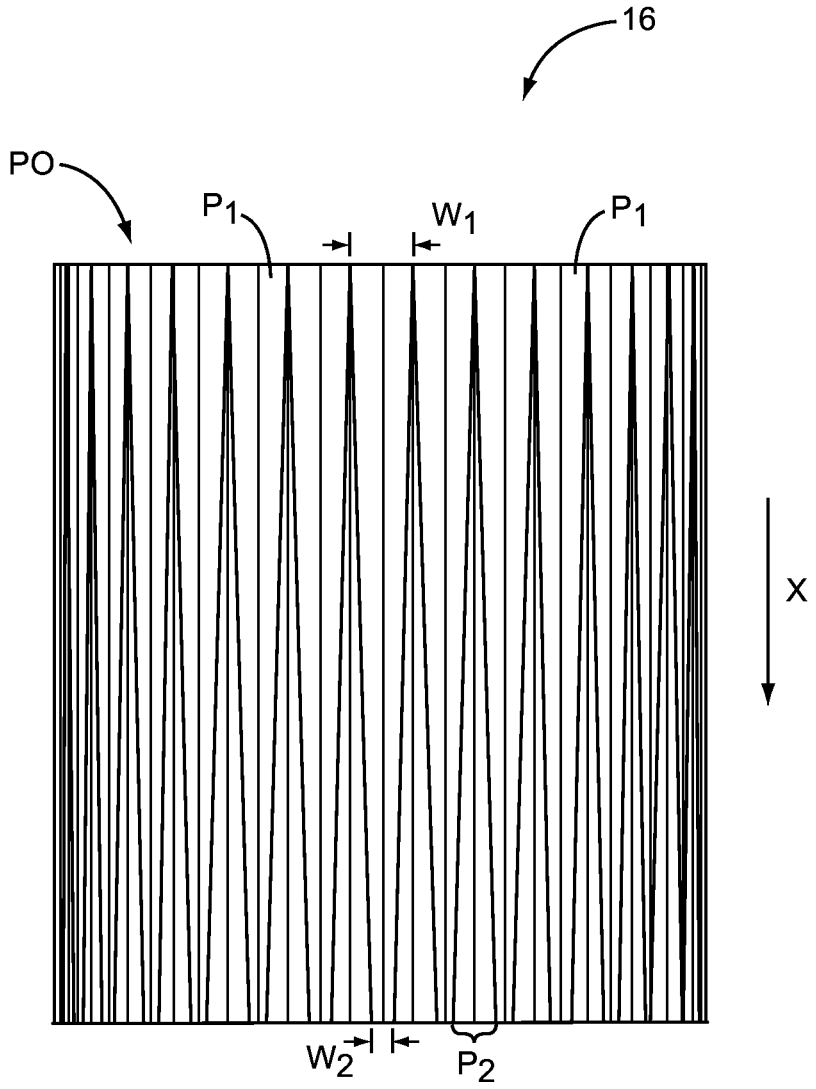
FIG. 13 is an interior view of a portion of the lens assembly according to a third embodiment of the disclosure.

FIG. 13 illustrates a variant of the embodiment of FIG. 12. In FIG. 13, each prism $P_1$ continuously tapers from a wider width $W_1$ at the proximal opening PO to a narrower width $W_2$ along the X direction. Prisms $P_2$ are provided between each adjacent pair of the prisms $P_1$ such that the prisms $P_1$ and prisms $P_2$ alternate with one another. The diffusers D may be similarly configured. While there is no interior surface of the body B exposed between the prisms $P_1$ and $P_2$ in FIG. 13, alternative embodiments may space apart each adjacent prism $P_1$ and $P_2$ to expose portions of the interior surface. The diffusers D may be similarly configured.

Figure 14:
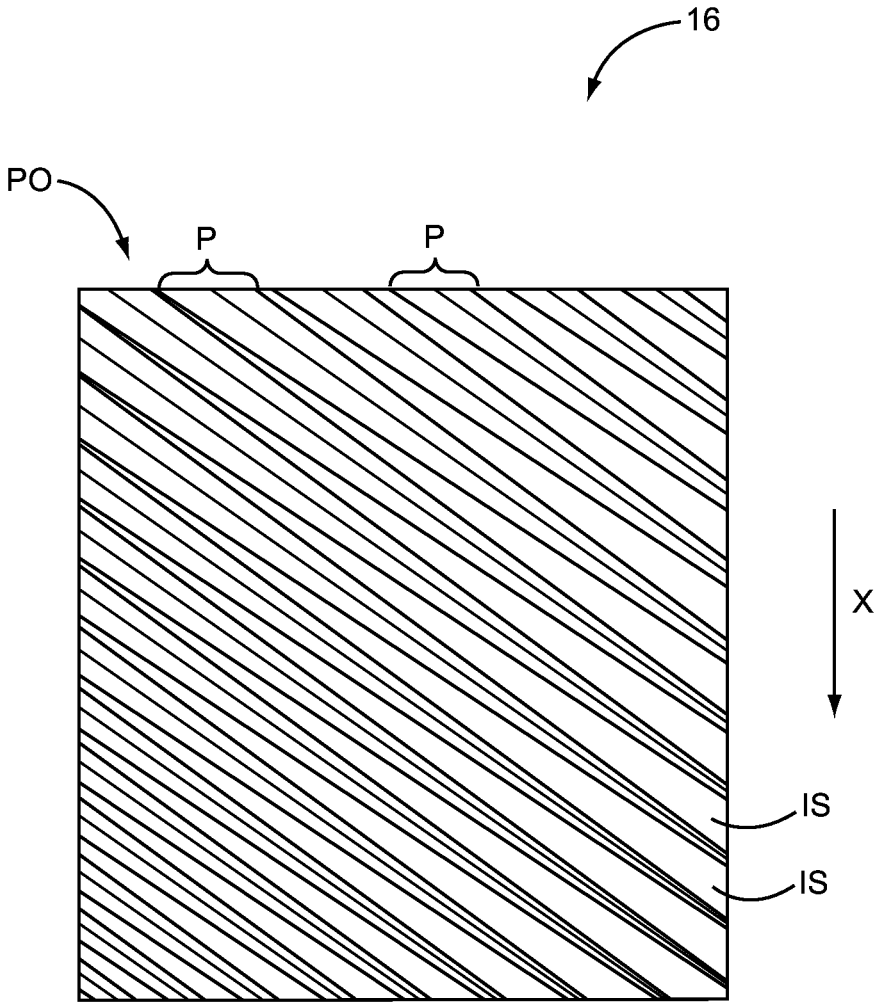
FIG. 14 is an interior view of a portion of the lens assembly according to a fourth embodiment of the disclosure.
Figure 15:
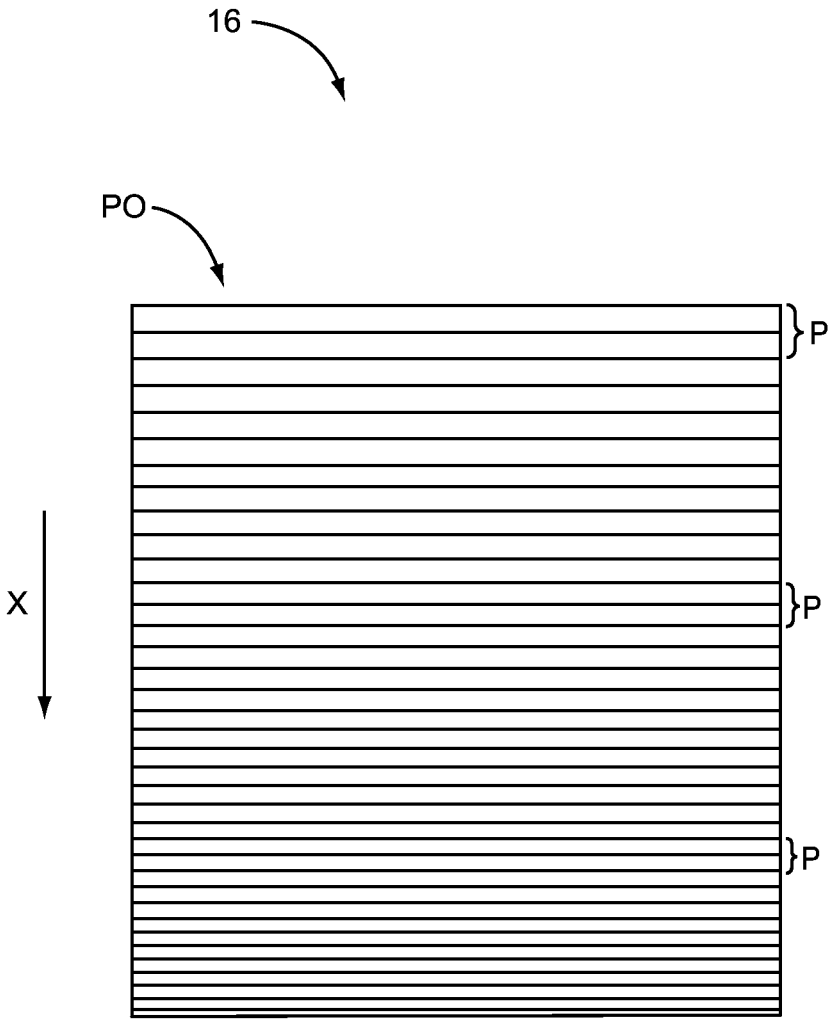
FIG. 15 is an interior view of a portion of the lens assembly according to a fifth embodiment of the disclosure.

The above embodiments orient the elongated prisms P and diffusers D such that they are substantially parallel with one another and the central axis A. However, various orientations are possible that employ prisms P and diffusers D that are of a constant width as well as those that are tapered. For example, the prisms P (as well as the diffusers D) may be oriented at an acute angle (less than 90 degrees) relative to the central axis A, as illustrated in FIG. 14, or substantially perpendicular to the central axis A, as illustrated in FIG. 15. Again, the prisms P and diffuses D may be uniform in width, tapered in both directions, immediately adjacent one another, or spaced apart from one another to expose portions of the respective interior and exterior surfaces. As illustrated in FIG. 15, the width of each successive prism P incrementally reduces along the X direction. However, the width of each successive prism P may incrementally increase along the X direction. The diffusers D may be similarly configured. Spaces may be provided between each prism P or diffuser D. Tapering may be employed, and the orientation of the diffusers may run substantially along the central axis A or at an acute angler therewith.

Figure 16:
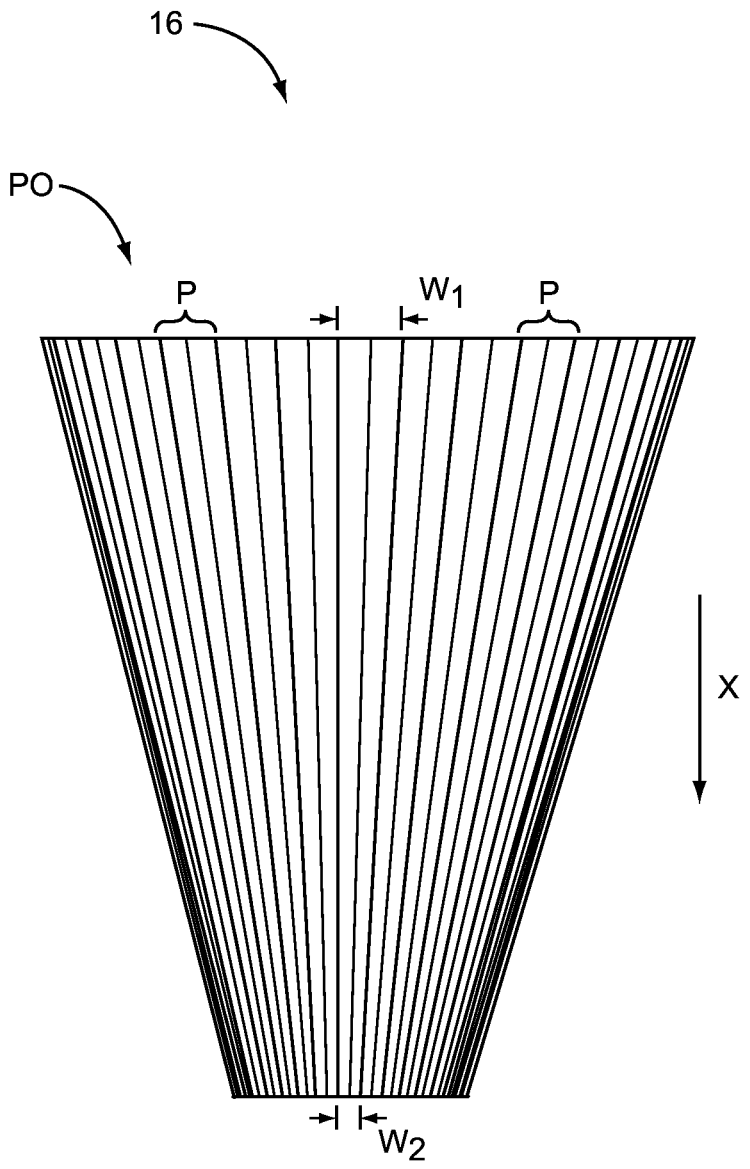
FIG. 16 is an interior view of a portion of the lens assembly according to a sixth embodiment of the disclosure.

FIG. 16 illustrates a conical shaped lens assembly 16, which may have a flat, semi-hemispherical, or like cover over the end opposite the proximal opening PO. In particular, FIG. 16 illustrates configuration of the prisms P, which are immediately adjacent one another, and thus taper from a wider width $W_1$ at the proximal opening PO to a narrower width $W_2$ along the X direction. Again, space may be provided between adjacent prisms P, and the orientation of the prisms P may be rotated to form an acute angle with or be substantially perpendicular to the central axis A. The diffusers D may be similarly configured.

In any of these embodiments, each elongated prism P and diffuser D may be continuous, substantially continuous, or discontinuous along a given line. In various embodiments, the prisms P and the diffusers D may cover more than about 25%, more than about 50%, more than about 75%, more than about 90%, or substantially all of the respective interior and exterior surfaces of the body of the lens assembly 16. The prisms P and the diffusers D may, but need not, cover substantially the same percentages of the respective interior and exterior surfaces of the body B of the lens assembly 16.

Figure 17:
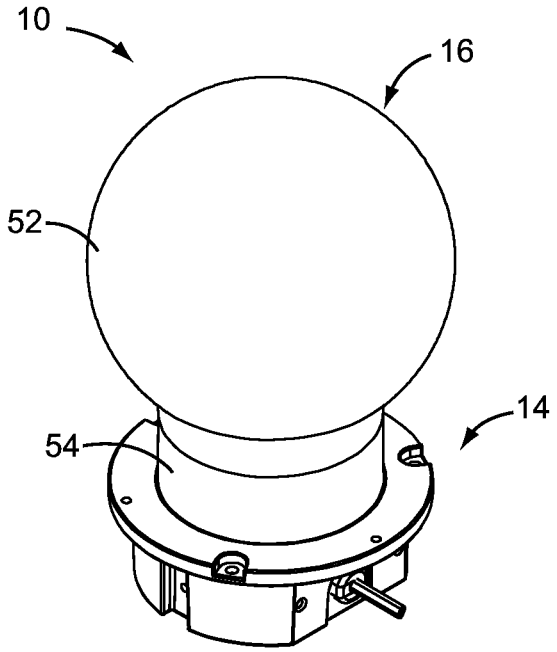
FIG. 17 is a front isometric view of a solid-state lighting fixture according to a seventh embodiment.

In addition to thoroughly mixing the light emitted from the array of LEDs 50 and making it appear as though the light emanated from within the cavity of the lens assembly 16, the lens assembly 16 may be designed, and perhaps the reflector cone 36 shaped, in a manner to control the relative concentration and shape of the resulting light beam that is provided from the lighting fixture 10. For example, a first lighting fixture 10 may be designed to provide a concentrated beam for a spotlight, wherein another may be designed to provide a widely dispersed beam for a floodlight. Exemplary embodiments for the base 14 and the lens assembly 16 are provided below. As with the above embodiments, the following embodiments are merely exemplary and should be construed as non-limiting. For each of the following embodiments, any of the above configurations for the prisms P and the diffusers D may be provided on the respective interior and exterior surfaces of the body B of the lens assembly 16. For example, the cross-sectional view provided in FIG. 11 may apply to each of the following examples. The prisms P and the diffusers D are not specifically shown such that the overall shape and contour of the lens assembly 16 and the associated base 14 is highlighted. Notably, any of the disclosed bases 14 may be used with any of the disclosed lens assemblies 16. FIG. 17 provides a lighting fixture 10 that has a lens assembly 16 according to another embodiment of the disclosure. The lens assembly 16 is provided with a substantially bulbous portion 52 that resides above a base portion 54, which has a substantially smaller diameter than the bulbous portion 52. As such, the lens assembly 16 takes on the shape of a traditional incandescent light bulb, but has a more modern base 14, as described above. The bulbous portion 52 and the base portion 54 may include the prisms P on an interior surface of the body and the diffusers D on an exterior surface of the body. Notably, the base 14 may house all or a portion of the control module electronics 28 wherein the control module is effectively integrated into the base 14. Alternatively, the control module electronics 28 may be provided in a separate control module 12, which may be electrically, and perhaps mechanically, coupled to the base 14, as described above. These configurations for the control module electronics 28 are applicable for all of the disclosed embodiments.

Figure 18:
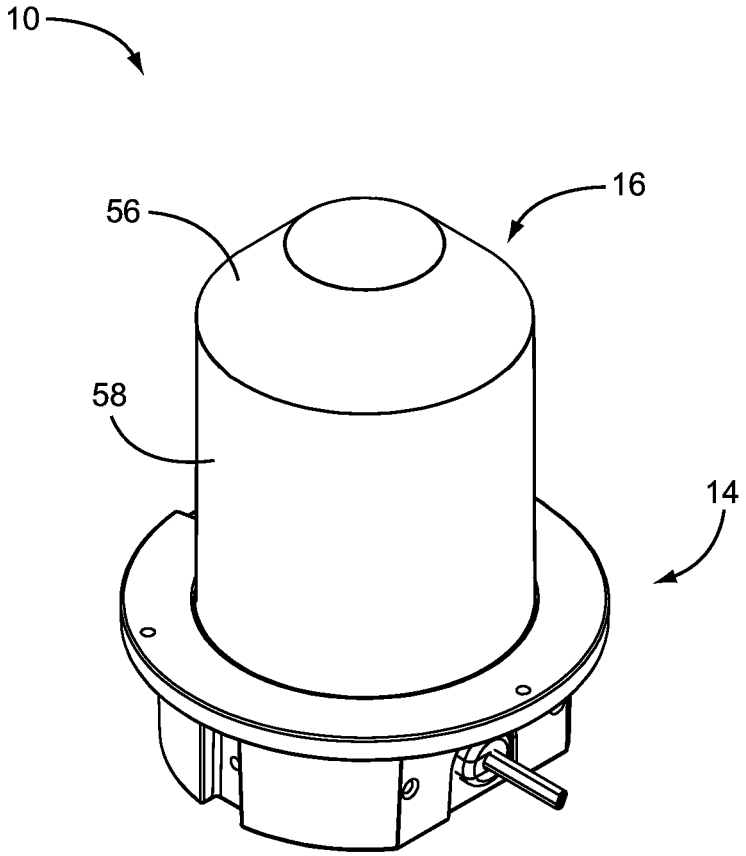
FIG. 18 is a front isometric view of a solid-state lighting fixture according to an eighth embodiment.

FIG. 18 provides a lighting fixture 10 that has a lens assembly 16 according to another embodiment of the disclosure. The lens assembly 16 is provided with a substantially conical portion 56 that resides above a cylindrical portion 58. The modern base 14 is provided. Any one or all of the cylindrical portion 58, the conical portion 56, and if provided and desired, an end cap for the conical portion 56 may include the prisms P on an interior surface of the body and the diffusers D on an exterior surface of the body.

Figure 19:
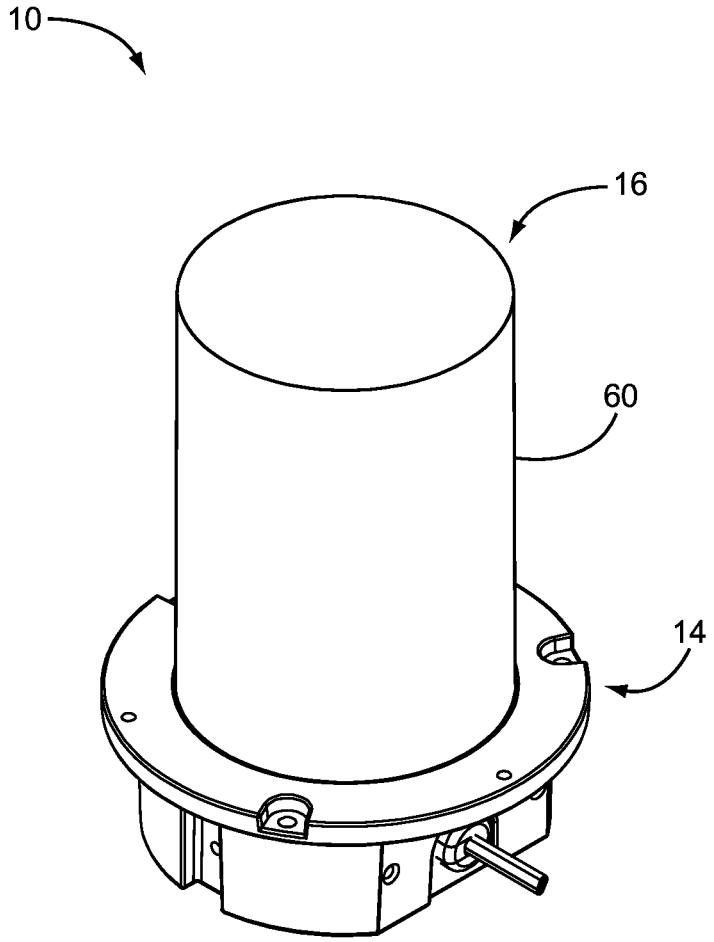
FIG. 19 is a front isometric view of a solid-state lighting fixture according to a ninth embodiment.

FIG. 19 provides a lighting fixture 10 that has a lens assembly 16 according to another embodiment of the disclosure. The lens assembly 16 is provided with a substantially cylindrical portion 60. The modern base 14 is provided. The substantially cylindrical portion 60, including the end cap, may include the prisms P on an interior surface of the body and the diffusers D on an exterior surface of the body.

Figure 20:
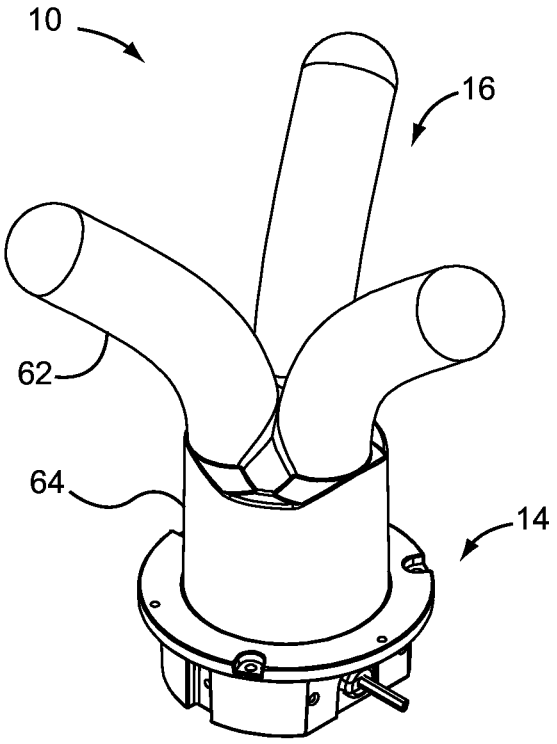
FIG. 20 is a front isometric view of a solid-state lighting fixture according to a tenth embodiment.

FIG. 20 provides a lighting fixture 10 that has a lens assembly 16 according to another embodiment of the disclosure. The lens assembly 16 is provided with a multi-tubular portion 62 that provides two or more light tubes. Notably, the central axis A (not labeled) for the curved light tubes will be curved as well. Three light tubes are illustrated. The multi-tubular portion 62 resides above a cylindrical portion 64 wherein each of the light tubes terminates with a dome. Each of the light tubes may include the prisms P on an interior surface of the light tube body and the diffusers on an exterior surface of the light tube body. The cylindrical portion 64 may also include the prisms P on an interior surface and the diffusers D on an exterior surface of its body. The modern base 14 is provided.

Figure 21:
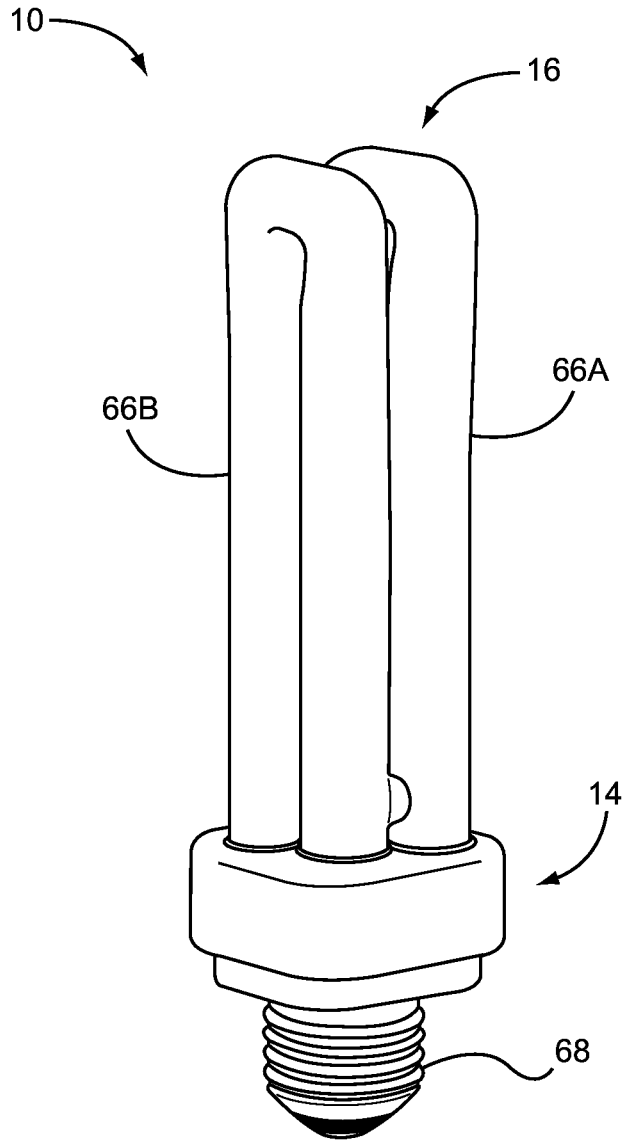
FIG. 21 is a front isometric view of a solid-state lighting fixture according to an eleventh embodiment.

FIG. 21 provides a lighting fixture 10 that has a lens assembly 16 that has the same form factor as a quad-tube compact fluorescent light (CFL) bulb. The lens assembly 16 includes two folded tubular portions 66A and 66B, each of which may include the prisms P on an interior surface of the body and the diffusers D on an exterior surface of the body. The base 14 is configured with a standard, threaded, Edison-type screw-in extension 68. The control module electronics 28 may be integrated in the base 14.

Figure 22:
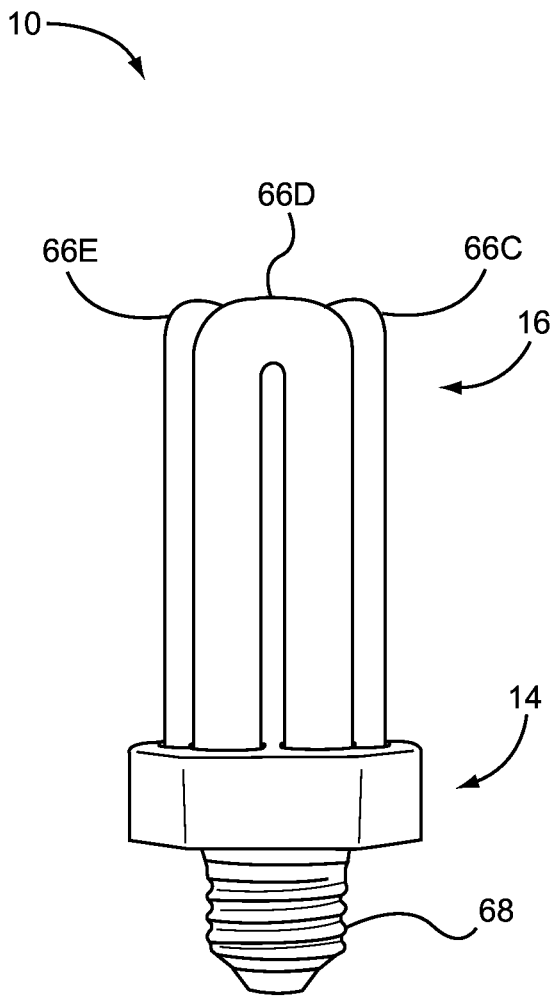
FIG. 22 is a front isometric view of a solid-state lighting fixture according to a twelfth embodiment.

FIG. 22 provides a lighting fixture 10 that has a lens assembly 16 that has the same form factor as a six-tube (CFL) bulb. The lens assembly 16 includes three folded tubular portions 66C through 66E, each of which may include the prisms P on an interior surface of the body and the diffusers D on an exterior surface of the body. The base 14 is configured with a standard, threaded, Edison-type screw-in extension 68. The control module electronics 28 may be integrated in the base 14. The central axis A (not labeled) for each of the folded tubular portions 66C through 66E is essentially U-shaped.

Figure 23:
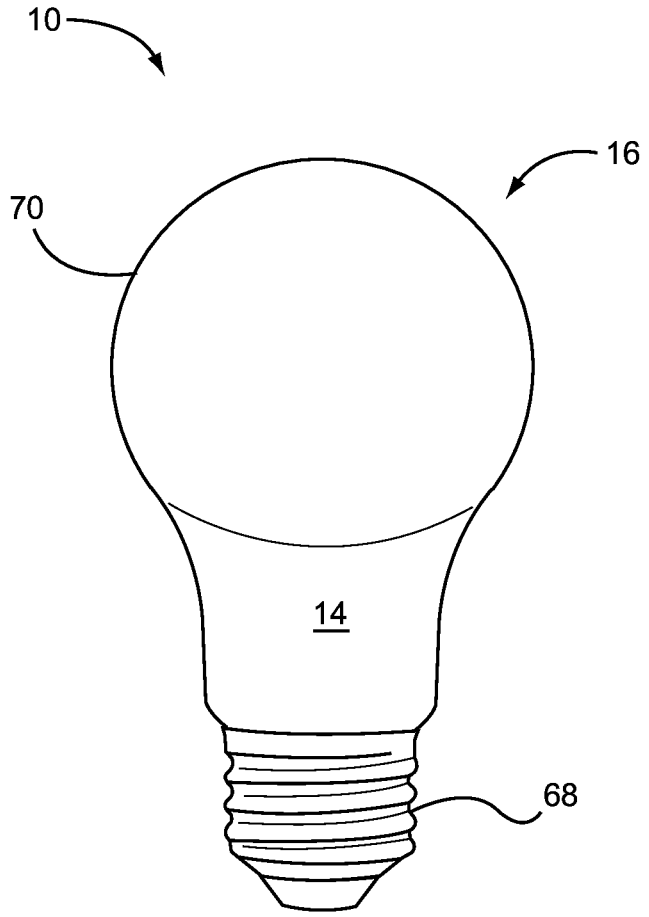
FIG. 23 is a front isometric view of a solid-state lighting fixture according to a thirteenth embodiment.

FIG. 23 provides a lighting fixture 10 that has a lens assembly 16 that has the same form factor as traditional Edison-type incandescent light bulb. The lens assembly 16 includes a bulbous portion 70 mounted on a base 14, which extends into the area that is traditionally part of the bulb portion of an incandescent bulb. The bulbous portion 70 may include the prisms P on an interior surface of the body and the diffusers D on an exterior surface of the body. The base 14 is configured with a standard, threaded, Edison-type screw-in extension 68. The control module electronics 28 may be integrated in the base 14.

Figure 24:
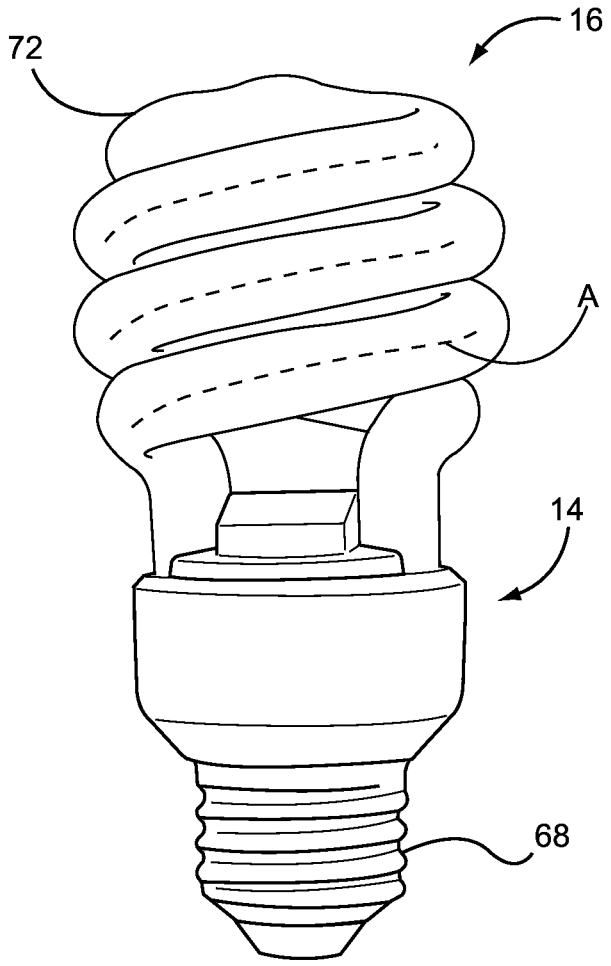
FIG. 24 is a front isometric view of a solid-state lighting fixture according to a fourteenth embodiment.

FIG. 24 provides a lighting fixture 10 that has a lens assembly 16, which has the same form factor as a dual "pig-tail"-style (CFL) bulb. The lens assembly 16 includes two tubular portions 72, which are effectively swirled about one another. Each tubular portion may include the prisms P on an interior surface of the body and the diffusers D on an exterior surface of the body. The base 14 is configured with a standard, threaded, Edison-type screw-in extension 68. The control module electronics 28 may be integrated in the base 14. The central axis A is illustrated as a dashed line.

For the embodiments of FIGS. 17-24, the proximal opening PO may be configured with the rearward extending tabs 40, as illustrated in FIG. 4, or other appropriate connecting mechanism for substantially permanently or removably coupling the lens assembly 16 to the base 14.

For any of the above embodiments, the light directed into the cavity of the lens assembly 16 by the array of LEDs 50 is significantly refracted and reflected by the prisms P. Light passing through the prisms P or other part of the body B may be diffused by the diffusers D as it departs the lens assembly 16. From a viewing perspective, the resultant light that departs the lens assembly 16 appears to have originated from an interior portion of the cavity in the lens assembly 16, as opposed to emanating from the array of LEDs 50.

By causing the light to appear to originate from the interior portion of the cavity, the lens assembly 16 allows the lighting fixture 10 to emulate a traditional light source, such as a traditional incandescent bulb with an Edison-type screw-in base, a compact fluorescent lamp (CFL), and the like. The light generated in these traditional bulbs actually originates from an interior portion of the bulb's lens assembly, as opposed to originating from a base on which the lens assembly is mounted. As such, light emanating from the lens assembly 16 of the present disclosure appears as light from a traditional light source, thus the radiant flux distribution of the lighting fixture 10 mimics the radiant flux distribution of a traditional light source.

Figure 25:
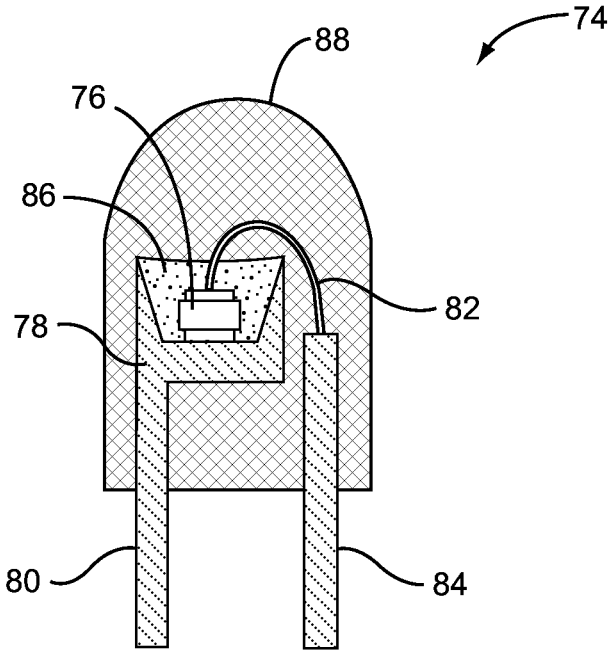
FIG. 25 shows an LED according to one embodiment.

A description of an exemplary embodiment of the array of LEDs 50 and the control module electronics 28 is now provided. As noted, the array of LEDs 50 includes a plurality of LEDs, such as the LEDs 74 illustrated in FIGS. 25 and 26. With reference to FIG. 25, a single LED chip 76 is mounted on a reflective cup 78 using solder or a conductive epoxy, such that ohmic contacts for the cathode (or anode) of the LED chip 76 are electrically coupled to the bottom of the reflective cup 78. The reflective cup 78 is either coupled to or integrally formed with a first lead 80 of the LED 74. One or more bond wires 82 connect ohmic contacts for the anode (or cathode) of the LED chip 76 to a second lead 84.

The reflective cup 78 may be filled with an encapsulant material 86 that encapsulates the LED chip 76. The encapsulant material 86 may be clear or may contain a wavelength conversion material, such as a phosphor, which is described in greater detail below. The entire assembly is encapsulated in a clear protective resin 88, which may be molded in the shape of a lens to control the light emitted from the LED chip 76.

Figure 26:
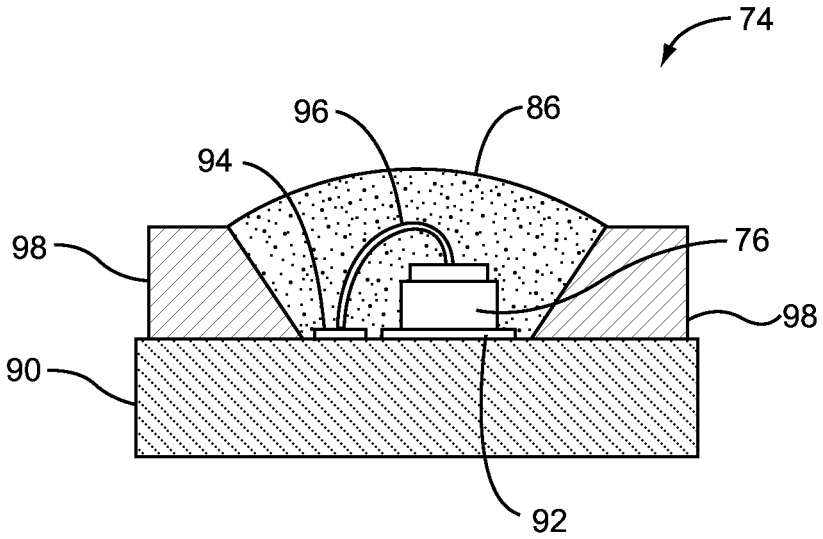
FIG. 26 shows an LED according to another embodiment.

An alternative package for an LED 74 is illustrated in FIG. 26, wherein the LED chip 76 is mounted on a substrate 90. In particular, the ohmic contacts for the anode (or cathode) of the LED chip 76 are directly mounted to first contact pads 92 on the surface of the substrate 90. The ohmic contacts for the cathode (or anode) of the LED chip 76 are connected to second contact pads 94, which are also on the surface of the substrate 90, using bond wires 96. The LED chip 76 resides in a cavity of a reflector structure 98, which is formed from a reflective material and functions to reflect light emitted from the LED chip 76 through the opening formed by the reflector structure 98. The cavity formed by the reflector structure 98 may be filled with an encapsulant material 86 that encapsulates the LED chip 76. The encapsulant material 86 may be clear or may contain a wavelength conversion material, such as a phosphor.

In either of the embodiments of FIGS. 25 and 26, if the encapsulant material 86 is clear, the light emitted by the LED chip 76 passes through the encapsulant material 86 and the protective resin 88 without any substantial shift in color. As such, the light emitted from the LED chip 76 is effectively the light emitted from the LED 74. If the encapsulant material 86 contains a wavelength conversion material, substantially all or a portion of the light emitted by the LED chip 76 in a first wavelength range may be absorbed by the wavelength conversion material, which will responsively emit light in a second wavelength range. The concentration and type of wavelength conversion material will dictate how much of the light emitted by the LED chip 76 is absorbed by the wavelength conversion material as well as the extent of the wavelength conversion. In embodiments where some of the light emitted by the LED chip 76 passes through the wavelength conversion material without being absorbed, the light passing through the wavelength conversion material will mix with the light emitted by the wavelength conversion material. Thus, when a wavelength conversion material is used, the light emitted from the LED 74 is shifted in color from the actual light emitted from the LED chip 76.

For example, the array of LEDs 50 may include a group of blue-shifted yellow (BSY) or blue-shifted green (BSG) LEDs 74 as well as a group of red LEDs 74. BSY LEDs 74 include an LED chip 76 that emits bluish light, and the wavelength conversion material is a yellow phosphor that absorbs the blue light and emits yellowish light. Even if some of the bluish light passes through the phosphor, the resultant mix of light emitted from the overall BSY LED 74 is yellowish light. The yellowish light emitted from a BSY LED 74 has a color point that falls above the Black Body Locus (BBL) on the 1931 CIE chromaticity diagram wherein the BBL corresponds to the various color temperatures of white light.

Similarly, BSG LEDs 74 include an LED chip 76 that emits bluish light; however, the wavelength conversion material is a greenish phosphor that absorbs the blue light and emits greenish light. Even if some of the bluish light passes through the phosphor, the resultant mix of light emitted from the overall BSG LED 74 is greenish light. The greenish light emitted from a BSG LED 74 has a color point that falls above the BBL on the 1931 CIE chromaticity diagram wherein the BBL corresponds to the various color temperatures of white light.

The red LEDs 74 generally emit reddish light at a color point on the opposite side of the BBL as the yellowish or greenish light of the BSY or BSG LEDs 74. As such, the reddish light from the red LEDs 74 mixes with the yellowish or greenish light emitted from the BSY or BSG LEDs 74 to generate white light that has a desired color temperature and falls within a desired proximity of the BBL. In effect, the reddish light from the red LEDs 74 pulls the yellowish or greenish light from the BSY or BSG LEDs 74 to a desired color point on or near the BBL. Notably, the red LEDs 74 may have LED chips 76 that natively emit reddish light wherein no wavelength conversion material is employed. Alternatively, the LED chips 76 may be associated with a wavelength conversion material, wherein the resultant light emitted from the wavelength conversion material and any light that is emitted from the LED chips 76 without being absorbed by the wavelength conversion material mixes to form the desired reddish light.

The blue LED chip 76 used to form either the BSY or BSG LEDs 74 may be formed from a gallium nitride (GaN), indium gallium nitride (InGaN), silicon carbide (SiC), zinc selenide (ZnSe), or like material system. The red LED chip 76 may be formed from an aluminum indium gallium nitride (AlInGaP), gallium phosphide (GaP), aluminum gallium arsenide (AlGaAs), or like material system. Exemplary yellow phosphors include cerium-doped yttrium aluminum garnet (YAG:Ce), yellow BOSE (Ba, O, Sr, Si, Eu) phosphors, and the like. Exemplary green phosphors include green BOSE phosphors, Lutetium aluminum garnet (LuAg), cerium doped LuAg (LuAg:Ce), Maui M535 from Lightscape Materials, Inc. of 201 Washington Road, Princeton, N.J. 08540, and the like. The above LED architectures, phosphors, and material systems are merely exemplary and are not intended to provide an exhaustive listing of architectures, phosphors, and materials systems that are applicable to the concepts disclosed herein.

Figure 27:
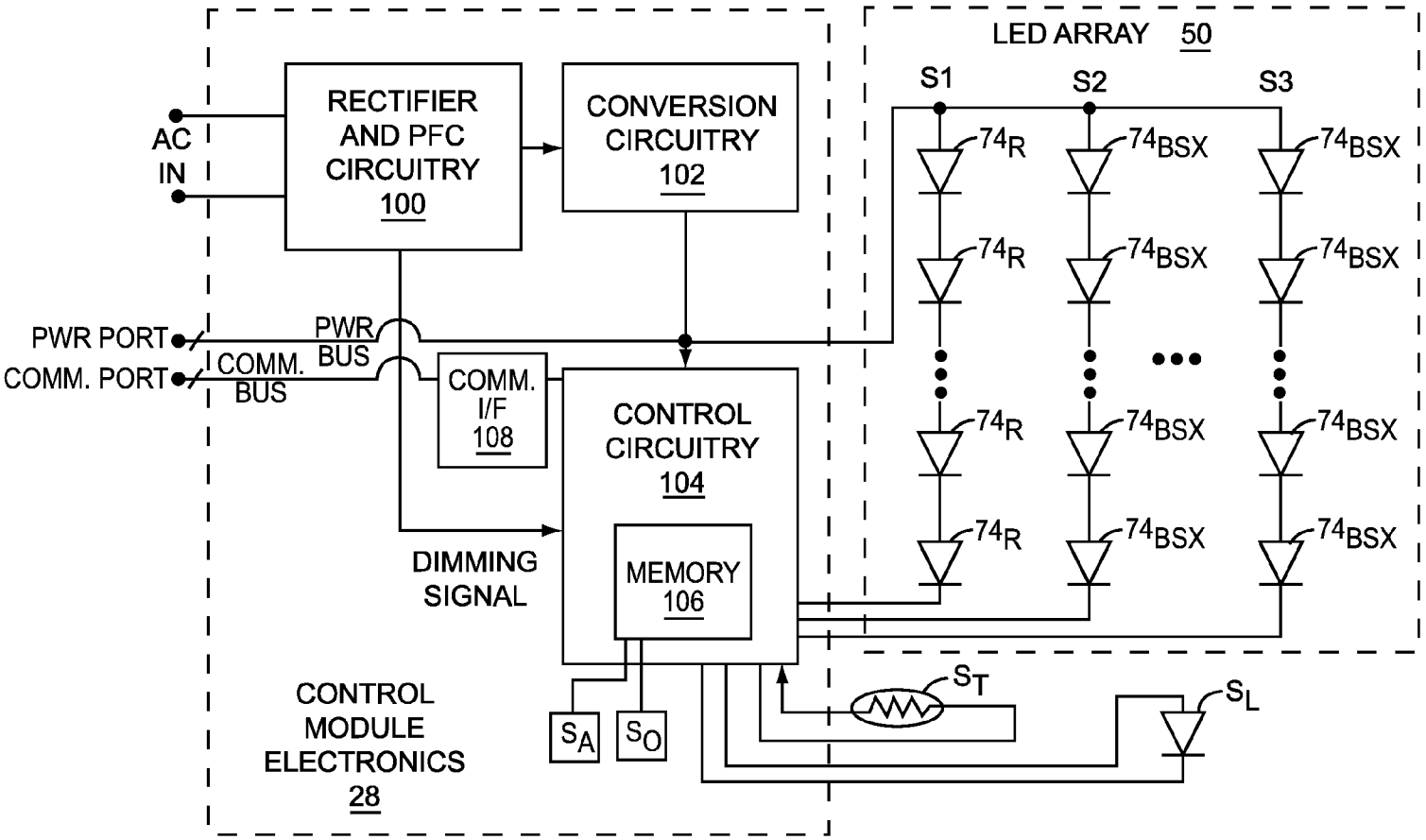
FIG. 27 is a schematic of the control module electronics according to one embodiment.

As noted, the array of LEDs 50 may include a mixture of red LEDs 74 and either BSY or BSG LEDs 74. The control module electronics 28 for driving the array of LEDs 50 is illustrated in FIG. 27 according to one embodiment of the disclosure. The array of LEDs 50 may be electrically divided into two or more strings of series connected LEDs 74. As depicted, there are three LED strings S1, S2, and S3. For clarity, the reference number "74" will include a subscript indicative of the color of the LED 74 in the following text where 'R' corresponds to red, 'BSY' corresponds to blue shifted yellow, 'BSG' corresponds to blue shifted green, and 'BSX' corresponds to either BSG or BSY LEDs. LED string 51 includes a number of red LEDs $\mathbf{74}_R$, LED string S2 includes a number of either BSY or BSG LEDs $\mathbf{74}_{BSX}$, and LED string S3 includes a number of either BSY or BSG LEDs $\mathbf{74}_{BSX}$. The control module electronics 28 control the current delivered to the respective LED strings S1, S2, and S3. The current used to drive the LEDs 74 is generally pulse width modulated (PWM), wherein the duty cycle of the pulsed current controls the intensity of the light emitted from the LEDs 74.

The BSY or BSG LEDs $\mathbf{74}_{BSX}$ in the second LED string S2 may be selected to have a slightly more bluish hue (less yellowish or greenish hue) than the BSY or BSG LEDs $\mathbf{74}_{BSX}$ in the third LED string S3. As such, the current flowing through the second and third strings S2 and S3 may be tuned to control the yellowish or greenish light that is effectively emitted by the BSY or BSG LEDs $\mathbf{74}_{BSX}$ of the second and third LED strings S2, S3. By controlling the relative intensities of the yellowish or greenish light emitted from the differently hued BSY or BSG LEDs $\mathbf{74}_{BSX}$ of the second and third LED strings S2, S3, the hue of the combined yellowish or greenish light from the second and third LED strings S2, S3 may be controlled in a desired fashion.

The ratio of current provided through the red LEDs $\mathbf{74}_R$ of the first LED string S1 relative to the currents provided through the BSY or BSG LEDs $\mathbf{74}_{BSX}$ of the second and third LED strings S2 and S3 may be adjusted to effectively control the relative intensities of the reddish light emitted from the red LEDs $\mathbf{74}_R$ and the combined yellowish or greenish light emitted from the various BSY or BSG LEDs $\mathbf{74}_{BSX}$. As such, the intensity and the color point of the yellowish or greenish light from BSY or BSG LEDs $\mathbf{74}_{BSX}$ can be set relative to the intensity of the reddish light emitted from the red LEDs $\mathbf{74}_R$. The resultant yellowish or greenish light mixes with the reddish light to generate white light that has a desired color temperature and falls within a desired proximity of the BBL.

Notably, the number of LED strings Sx may vary from one to many and different combinations of LED colors may be used in the different strings. As such, the array of LEDs 50 may have one or more strings Sx. Each LED string Sx may have LEDs 74 of the same color, variations of the same color, or substantially different colors, such as red, green, and blue. In one embodiment, a single LED string may be used for the array of LEDs 50, wherein the LEDs in the string are all substantially identical in color, vary in substantially the same color, or include different colors. In another embodiment, three LED strings Sx with red, green, and blue LEDs may be used for the array of LEDs 50, wherein each LED string Sx is dedicated to a single color. In yet another embodiment, at least two LED strings Sx may be used, wherein different colored BSY LEDs are used in one of the LED strings Sx and red LEDs are used in the other of the LED strings Sx.

The control module electronics 28 depicted in FIG. 27 generally include rectifier and power factor correction (PFC) circuitry 100, conversion circuitry 102, and control circuitry 104. The rectifier and power factor correction circuitry 100 is adapted to receive an AC power signal (AC IN), rectify the AC power signal, and correct the power factor of the AC power signal. The resultant signal is provided to the conversion circuitry 102, which converts the rectified AC power signal to a DC power signal. The DC power signal may be boosted or bucked to one or more desired DC voltages by DC-DC converter circuitry, which is provided by the conversion circuitry 102. Internally, The DC power signal may be used to power the control circuitry 104 and any other circuitry provided in the control module electronics 28.

The DC power signal is also provided to the power bus, which is coupled to one or more power ports, which may be part of the standard communication interface. The DC power signal provided to the power bus may be used to provide power to one or more external devices that are coupled to the power bus and separate from the control module electronics 28. These external devices may include a communications module, which supports wired or wireless networking for communicating with other lighting fixtures 10, switches, sensors, remote controllers or control systems, and the like. Accordingly, these external devices may rely on the control module electronics 28 for power and can be efficiently and cost effectively designed accordingly. The rectifier and PFC circuitry 100 and the conversion circuitry 102 of the control module electronics 28 may be robustly designed in anticipation of being required to supply power to not only its internal circuitry and the array of LEDs 50, but also to supply power to these external devices as well. Such a design greatly simplifies the power supply design, if not eliminating the need for a power supply, and reduces the cost for these external devices.

As illustrated, the DC power signal may be provided to another port, which will be connected by cabling to the array of LEDs 50. In this embodiment, the supply line of the DC power signal is ultimately coupled to the first end of each of the LED strings S1, S2, and S3 in the array of LEDs 50. The control circuitry 104 is coupled to the second end of each of the LED strings S1, S2, and S3 by the cabling. Based on any number of fixed or dynamic parameters, the control circuitry 104 may individually control the pulse width modulated current that flows through the respective LED strings S1, S2, and S3 such that the resultant white light emitted from the LED strings S1, S2, and S3 has a desired color temperature and falls within a desired proximity of the BBL. Certain of the many variables that may impact the current provided to each of the LED strings S1, S2, and S3 include: the magnitude of the AC power signal, the resultant white light, and the ambient temperature of the control module electronics 28 or array of LEDs 50. Notably, the architecture used to drive the array of LEDs 50 in this embodiment is merely exemplary, as those skilled in the art will recognize other architectures for controlling the drive voltages and currents presented to the LED strings S1, S2, and S3.

In certain instances, a dimming device controls the AC power signal. The rectifier and PFC circuitry 100 may be configured to detect the relative amount of dimming associated with the AC power signal and provide a corresponding dimming signal to the control circuitry 104. Based on the dimming signal, the control circuitry 104 will adjust the current provided to each of the LED strings S1, S2, and S3 to effectively reduce the intensity of the resultant white light emitted from the LED strings S1, S2, and S3 while maintaining the desired color temperature. Dimming instructions may alternatively be delivered from the communications module to the control circuitry 104 in the form of a command via the communication bus.

The intensity or color of the light emitted from the LEDs 74 may be affected by ambient temperature. If associated with a thermistor $S_T$ or other temperature-sensing device, the control circuitry 104 can control the current provided to each of the LED strings S1, S2, and S3 based on ambient temperature in an effort to compensate for adverse temperature effects. The intensity or color of the light emitted from the LEDs 74 may also change over time. If associated with an LED light sensor $S_L$, the control circuitry 104 can measure the color of the resultant white light being generated by the LED strings S1, S2, and S3 and adjust the current provided to each of the LED strings S1, S2, and S3 to ensure that the resultant white light maintains a desired color temperature or other desired metric. The control circuitry 104 may also monitor the output of occupancy and ambient light sensors $S_O$ and $S_A$ for occupancy and ambient light information.

The control circuitry 104 may include a central processing unit (CPU) and sufficient memory 106 to enable the control circuitry 104 to bidirectionally communicate with the communications module or other devices over the communication bus through an appropriate communication interface (I/F) 108 using a defined protocol, such as the standard protocol described above. The control circuitry 104 may receive instructions from the communications module or other device and take appropriate action to implement the received instructions. The instructions may range from controlling how the LEDs 74 of the array of LEDs 50 are driven to returning operational data, such as temperature, occupancy, light output, or ambient light information, that was collected by the control circuitry 104 to the communications module or other device via the communication bus. The functionality of the communications module may be integrated into the control module electronics 28, and vice versa.

Those skilled in the art will recognize improvements and modifications to the preferred embodiments of the present disclosure. All such improvements and modifications are considered within the scope of the concepts disclosed herein and the claims that follow.

What is claimed is:

1. A lighting fixture comprising:

a base;

a solid-state light source mounted to the base; and a lens assembly comprising a body forming a cavity and having a proximal opening that is coupled to the base such that light emitted from the solid-state light source is directed into the cavity via the proximal opening, wherein a plurality of prisms are provided on at least a portion of an interior surface of the body and a plurality of diffusers are provided on at least a portion of an exterior surface of the body.

2. The lighting fixture of claim 1 wherein light emanating from the lens assembly has a radiant flux distribution of a non-solid-state light source.

3. The lighting fixture of claim 1 wherein light emanating from the lens assembly has a radiant flux distribution of an incandescent light bulb.

4. The lighting fixture of claim 1 wherein light emanating from the lens assembly has a radiant flux distribution of a compact fluorescent light bulb.

5. The lighting fixture of claim 1 wherein the base comprises electronics sufficient to drive the solid-state light source.

6. The lighting fixture of claim 1 wherein the base further comprises a threaded Edison-type extension.

7. The lighting fixture of claim 1 wherein from a perspective external to the lens assembly, light emanating from the lens assembly appears to originate from within the cavity of the lens assembly instead of from a location of the solid-state light source.

8. The lighting fixture of claim 1 wherein from a perspective external to the lens assembly, light emanating from the lens assembly appears to originate from within the cavity of the lens assembly instead of from a location of the solid-state light source that is located outside of the cavity.

9. The lighting fixture of claim 8 wherein from the perspective external to the lens assembly, the light emanating from the lens assembly appears to originate from within an interior portion of the cavity of the lens assembly.

10. The lighting fixture of claim 1 wherein prisms of the plurality of prisms are elongated.

11. The lighting fixture of claim 10 wherein a cross-sectional shape of the prisms is substantially triangular.

12. The lighting fixture of claim 1 wherein diffusers of the plurality of diffusers are elongated.

13. The lighting fixture of claim 12 wherein a cross-sectional shape of the diffusers is semi-hemispherical.

14. The lighting fixture of claim 1 wherein prisms of the plurality of prisms are elongated and diffusers of the plurality of diffusers are elongated.

15. The lighting fixture of claim 1 wherein the plurality of prisms cover more than about 50% of the interior surface.

16. The lighting fixture of claim 1 wherein the plurality of diffusers cover more than about 50% of the exterior surface.

17. The lighting fixture of claim 1 wherein the plurality of prisms cover more than about 75% of the interior surface.

18. The lighting fixture of claim 1 wherein the plurality of diffusers cover more than about 75% of the exterior surface.

19. The lighting fixture of claim 1 wherein the plurality of prisms cover more than about 75% of the interior surface and the plurality of diffusers cover more than about 75% of the exterior surface.

20. The lighting fixture of claim 1 wherein the plurality of prisms cover more than about 90% of the interior surface and the plurality of diffusers cover more than about 90% of the exterior surface.

21. The lighting fixture of claim 1 wherein the plurality of prisms and the plurality of diffusers are elongated and run substantially along a central axis of the body.

22. The lighting fixture of claim 1 wherein the plurality of prisms and the plurality of diffusers are elongated and run substantially perpendicular to a central axis of the body.

23. The lighting fixture of claim 1 wherein the plurality of prisms and the plurality of diffusers are elongated and run substantially diagonally relative to a central axis of the body.

24. The lighting fixture of claim 1 wherein prisms of the plurality of prisms are tapered.

25. The lighting fixture of claim 1 wherein diffusers of the plurality of diffusers are tapered.

26. The lighting fixture of claim 1 wherein prisms of the plurality of prisms are immediately adjacent one another.

27. The lighting fixture of claim 1 wherein prisms of the plurality of prisms are spaced apart from one another such that portions of the interior surface are exposed.

28. The lighting fixture of claim 1 wherein prisms of the plurality of diffusers are spaced apart from one another such that portions of the exterior surface are exposed.

29. The lighting fixture of claim 1 wherein the solid-state light source comprises a plurality of LEDs.

30. The lighting fixture of claim 29 wherein at least a first LED of the plurality of LEDs emits light of a first color and at least a second LED of the plurality of LEDs emits light of a second color, which is different than the first color.

31. A lighting fixture comprising:

a base;

a solid-state light source mounted to the base;

a lens assembly comprising a body forming a cavity and having a proximal opening that is coupled to the base such that light emitted from the solid-state light source is directed into the cavity via the proximal opening, wherein:

a plurality of elongated prisms having a substantially triangular cross-sectional shape are provided on at least a portion of an interior surface of the body;

a plurality of diffusers having a semi-hemispherical shape are provided on at least a portion of an exterior surface of the body;

light emanating from the lens assembly has a radiant flux distribution of a non-solid-state light source.

32. The lighting fixture of claim 31 wherein the radiant flux distribution is that of an incandescent light bulb.

33. The lighting fixture of claim 31 wherein the radiant flux distribution is that of a compact fluorescent light bulb.

34. The lighting fixture of claim 31 wherein from a perspective external to the lens assembly, the light emanating from the lens assembly appears to originate from within the cavity of the lens assembly instead of from a location of the solid-state light source.

35. The lighting fixture of claim 31 wherein from a perspective external to the lens assembly, the light emanating from the lens assembly appears to originate from within the cavity of the lens assembly instead of from a location of the solid-state light source that is located outside of the cavity.

36. The lighting fixture of claim 35 wherein the plurality of prisms cover more than about 50% of the interior surface and the plurality of diffusers cover more than about 50% of the exterior surface.

37. A lens assembly comprising a body forming a cavity and having a proximal opening configured to couple to a base such that light emitted from a solid-state light source mounted to the base is directed into the cavity via the proximal opening, wherein a plurality of prisms are provided on at least a portion of an interior surface of the body and a plurality of diffusers are provided on at least a portion of an exterior surface of the body, and wherein light emanating from the lens assembly has a radiant flux distribution of a non-solid-state light source.

38. A lighting fixture comprising:

a base;

a solid-state light source mounted to the base; and a lens assembly comprising a body forming a cavity and having a proximal opening that is coupled to the base such that light emitted from the solid-state light source is directed into the cavity via the proximal opening, wherein the body is configured such that light emanating from the lens assembly has a radiant flux distribution of a non-solid state light source and appears to originate from within the cavity of the lens assembly instead of from a location of the solid-state light source.

* * * * *